US012540770B2

(12) United States Patent
Park et al.

(10) Patent No.: US 12,540,770 B2
(45) Date of Patent: Feb. 3, 2026

(54) REFRIGERATOR

(71) Applicant: LG ELECTRONICS INC., Seoul (KR)

(72) Inventors: Myeongseong Park, Seoul (KR); Chun Hee Hong, Seoul (KR); Seongjun Yun, Seoul (KR); Hyeonu Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 284 days.

(21) Appl. No.: 18/214,029

(22) Filed: Jun. 26, 2023

(65) Prior Publication Data

US 2024/0077247 A1 Mar. 7, 2024

(30) Foreign Application Priority Data

Sep. 2, 2022 (KR) ..... 10-2022-0111242

(51) Int. Cl.
*F25D 23/06* (2006.01)

(52) U.S. Cl.
CPC ..... *F25D 23/065* (2013.01); *F25D 23/062* (2013.01)

(58) Field of Classification Search
CPC ..... F25D 23/065; F25D 23/062; F25D 23/069
See application file for complete search history.

(56) References Cited

U.S. PATENT DOCUMENTS 6,350,002 B1 * 2/2002 Takaoka ..... F25D 23/065 220/592.02
6,471,313 B1 * 10/2002 Ueda ..... F25D 23/063 24/297
2012/0313497 A1 * 12/2012 Jang ..... F25D 23/069 312/401
2015/0059399 A1 * 3/2015 Hwang ..... F25D 23/068 312/405
2017/0321958 A1 * 11/2017 Ramm ..... F25D 29/00
2018/0187957 A1 * 7/2018 Jung ..... F25D 23/062
2018/0224182 A1 * 8/2018 Besore ..... F25D 17/045
2024/0068739 A1 * 2/2024 Yun ..... F25D 23/066
2024/0133611 A1 * 4/2024 Park ..... F25D 17/067

(Continued)

FOREIGN PATENT DOCUMENTS

EP 3401620 A1 * 11/2018 ..... F25D 11/02
JP 52-27671 U 2/1977
JP 2-124475 U 10/1990

(Continued)

*Primary Examiner* — Daniel J Rohrhoff

(74) *Attorney, Agent, or Firm* — Birch, Stewart, Kolasch & Birch, LLP

(57) ABSTRACT

A refrigerator includes a storage casing having a first storage compartment and a front wall protruding outward along a front edge of the storage compartment; a hot line located along a rear surface of the front wall; and a first barrier located inside the first storage compartment so as to cross the storage first compartment in a left and right direction, the first barrier partitioning the first storage compartment into a first upper storage compartment and a first lower storage compartment. A hot line outlet configured to allow a first portion of the hot line to be withdrawn therethrough is located in one side of the first storage casing in contact with the first barrier. A second portion of the hot line extends inwardly with respect to the first storage casing so as to overlap a front surface of the first barrier.

20 Claims, 19 Drawing Sheets

(56) References Cited

U.S. PATENT DOCUMENTS

| | | | | |
|---|---|---|---|---|
| 2024/0263868 | A1* | 8/2024 | Park | F25D 21/02 |
| 2024/0280314 | A1* | 8/2024 | Park | F25D 23/066 |

FOREIGN PATENT DOCUMENTS

| | | | | | |
|---|---|---|---|---|---|
| JP | 07239178 | A | * | 9/1995 | |
| JP | 11-101566 | A | | 4/1999 | |
| JP | 2001-66049 | A | | 3/2001 | |
| JP | 2008-32258 | A | | 2/2008 | |
| KR | 20090115596 | A | * | 11/2009 | F25D 23/028 |

* cited by examiner

REFRIGERATOR

CROSS-REFERENCE TO RELATED APPLICATION

This application claims priority to and the benefit of Korean Patent Application No. 10-2022-0111242, filed on Sep. 2, 2022, the disclosure of which is incorporated herein by reference in its entirety.

BACKGROUND

Field

The present disclosure relates to a refrigerator, and more particularly, to a refrigerator including a storage casing partitioned into a plurality of storage compartments having various functions.

Description of Related Art

A refrigerator is a home appliance that supplies cool air generated using circulation of a refrigerant to a storage room to keep various types of stored objects fresh for a long time in the storage room.

Recently, refrigerators having various structures that may harmonize with an environment in which the refrigerator is placed and surrounding furniture or home appliances have been developed.

For example, the refrigerator may be combined with the furniture or the home appliance to constitute a wall surface in a built-in type.

In one example, a cabinet of the refrigerator may be formed by coupling an inner casing and an outer casing forming an outer surface of the inner casing to each other.

In this case, the inner casing may be formed in various molding schemes, and may be, for example, integrally formed using a vacuum molding scheme.

The vacuum molding scheme may proceed as follows.

First, a resin sheet for molding is heated so as to be easily deformed, and then placed in a vacuum casing with one side open.

Then, a vacuum is made inside the vacuum casing, so that a portion of the heated resin sheet is introduced into the vacuum casing.

In this regard, because an edge of the resin sheet is fixed outside the vacuum casing, as a middle portion of the resin sheet is stretched and sucked into the vacuum casing, the resin sheet is primarily molded.

Next, a mold having a shape corresponding to the inner casing to be made is positioned close to the primarily molded resin sheet, and high-pressure air is blown into the vacuum casing to bring the resin sheet into close contact with the mold, thereby secondarily molding the resin sheet.

In addition, after cooling the resin sheet in close contact with the mold, a molded product is removed from the mold, then an unnecessary portion is removed from the molded product of the inner casing, and then a groove or the like necessary for assembly is defined, thereby performing the vacuum molding of the inner casing.

However, when the inner casing is molded in such vacuum molding scheme, it is difficult to form a structure having a separate function, such as a structure dividing the inner casing into a plurality of compartments, integrally with the inner casing.

A demand for large-size refrigerators is increasing recently.

Along with the trend of increasing the refrigerator in size, there is also an increasing demand for a development of a refrigerator having a structure that may be divided into the maximum number of storage rooms such that a refrigerating compartment or a freezer compartment may be used by being partitioned as much as possible.

In addition, a demand for a storage room in a scheme in which the refrigerating compartment and the freezer compartment may be freely switched based on a user's preference is also increasing. Therefore, there is a need to develop a refrigerator that may satisfy the user's needs as described above.

SUMMARY

A purpose of the present disclosure is to provide a refrigerator including a barrier, which is a separate structure that partitions a storage compartment of a storage casing including one or more storage compartments into a plurality of storage compartments.

Another purpose of the present disclosure is to provide a refrigerator that includes a barrier capable of sealing a front door.

Another purpose of the present disclosure is to provide a refrigerator including a barrier that may function as a lighting when a front door is opened.

Another purpose of the present disclosure is to provide a refrigerator capable of minimizing a structure concealing a hot line disposed in a storage casing.

Another purpose of the present disclosure is to provide a refrigerator including a storage compartment that may be switched into a freezer compartment or a refrigerating compartment.

Another purpose of the present disclosure is to provide a refrigerator that includes a storage casing of a 4-door drawer-type.

The purposes of the present disclosure are not limited to the above-mentioned purposes, and other purposes and advantages of the present disclosure that are not mentioned may be understood by the following description and will be more clearly understood by the embodiment of the present disclosure. In addition, it will be readily appreciated that the purposes and advantages of the present disclosure may be realized by means shown in the claims and combinations thereof.

A refrigerator according to an embodiment of the present disclosure for solving the above problems includes a storage casing including at least one storage compartment, and a first barrier fixed inside the storage compartment so as to cross the storage compartment in a left and right direction.

In this case, the first barrier fixed inside the storage compartment partitions the storage compartment into a first upper storage compartment and a first lower storage compartment.

In addition, a refrigerator according to an embodiment of the present disclosure for solving the above problems includes a storage casing including a first storage compartment and a second storage compartment arranged side by side in a left and right direction, a first barrier disposed in the first storage compartment so as to cross the first storage compartment in the left and right direction, and a second barrier disposed in the second storage compartment so as to cross the second storage compartment in the left and right direction.

In this case, the first barrier extends from a front surface toward a rear surface of the first storage compartment so as to be in contact with the rear surface of the first storage compartment, and the second barrier extends from a front surface toward a rear surface of the second storage compartment so as to be spaced apart from the rear surface of the second storage compartment.

The refrigerator according to the present disclosure includes the barrier, which is the separate structure that partitions the storage compartment of the storage casing into the plurality of storage compartments, thereby implementing, with the separate molding method, the structure that is difficult to implement with the molding method of molding the storage casing.

In addition, in the refrigerator according to the present disclosure, the barrier containing the metal material may be disposed at the position corresponding to the front door including the gasket magnet to perform the function of sealing the cool air inside the refrigerator.

In addition, in the refrigerator according to the present disclosure, the barrier for partitioning the storage compartment of the storage casing in the vertical direction includes the lighting, so that there is no need to secure separate space for installing the lighting in the storage casing, thereby increasing the space utilization.

In addition, in the refrigerator according to the present disclosure, the hot line is installed along the rear surface of the storage casing, but the portion of the hot line installed along the front surface of the storage casing is placed along the front surface of the barrier and covered with the front plate, thereby providing the hot line installation structure that may minimize the structure that conceals the hot line.

In addition, in the refrigerator according to the present disclosure, as the cool air respectively circulating through the plurality of storage compartments partitioned by the barrier are discharged and recovered via the different cool air outlets and the different cool air recovery ports, the plurality of storage compartments may be controlled independently, so that the specific storage compartment may be switched into the freezer compartment or the refrigerating compartment based on the user's choice.

In addition, the refrigerator according to the present disclosure includes the storage casing including the plurality of storage compartments arranged side by side in the left and right direction and includes the plurality of barriers respectively crossing the storage compartments in the left and right direction again, thereby implementing the 4-door drawer-type storage casing.

In addition to the above effects, specific effects of the present disclosure will be described together while describing specific details for implementing the present disclosure.

DETAILED DESCRIPTIONS

Figure 1:
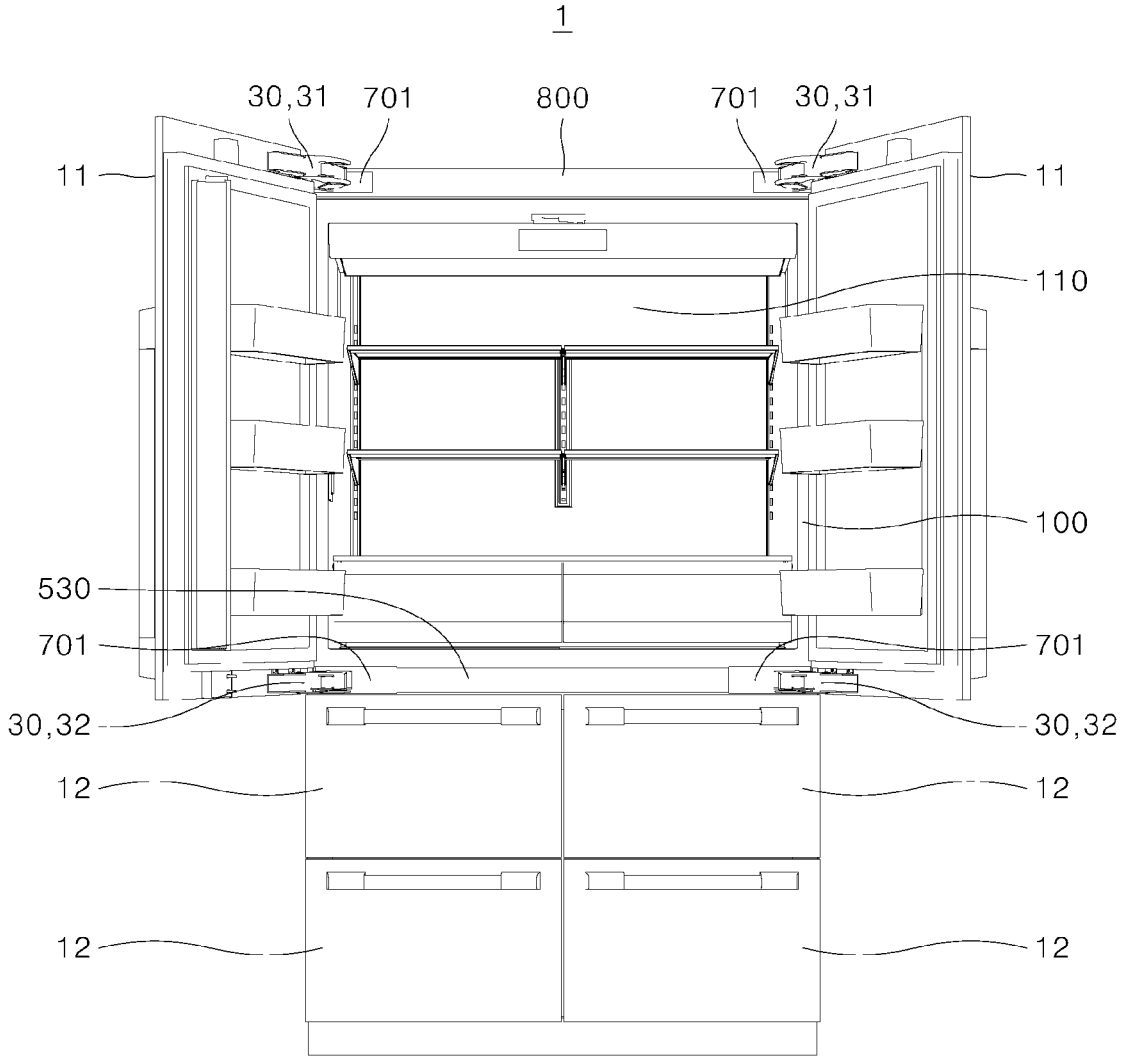
FIG. 1 is a front view of a refrigerator in a state in which first doors are opened.

The above objects, features, and advantages will be described in detail later with reference to the accompanying drawings. Accordingly, a person having ordinary knowledge in the technical field to which the present disclosure belongs will be able to easily implement the technical idea of the present disclosure. In describing the present disclosure, when it is determined that a detailed description of a known technology related to the present disclosure may unnecessarily obscure the gist of the present disclosure, the detailed description will be omitted. Hereinafter, preferred embodiments according to the present disclosure will be described in detail with reference to the accompanying drawings. In the drawings, the same reference numerals are used to indicate the same or similar components.

Although first, second, and the like are used to describe various components, such components are not limited by such terms. Such terms are only used to distinguish one component from another component, and unless otherwise stated, a first component may be a second component.

Throughout the present document, unless otherwise stated, each component may include a single component or a plurality of components.

In the following, it may mean that when one component is disposed "on (or below)" or "on a top of (or under)" another component, not only the former may be placed in contact with an upper surface (or a lower surface) of the latter component, but also another intervening component may be interposed between the latter component and the former component disposed on (or below) the latter.

In addition, it will be understood that when a component is referred to as being "connected to", or "coupled to" another component, the components may be directly connected to or coupled to each other, but another intervening component may be "interposed" therebetween or the components may be "connected to" or "coupled to" each other via the intervening component.

As used herein, the singular constitutes "a" and "an" are intended to include the plural constitutes as well, unless the context clearly indicates otherwise. In this application, terms such as "composed of" or "include" should not be construed as necessarily including all of various components or steps described herein, but should be construed that some components or steps among those may not be included or additional components or steps may be further included.

Throughout the present document, "A and/or B" means A, B, or A and B, unless otherwise specified, and "C to D" means equal to or greater than C and equal to or smaller than D unless otherwise specified.

Hereinafter, a refrigerator according to some embodiments of the present disclosure will be described.

Figure 2:
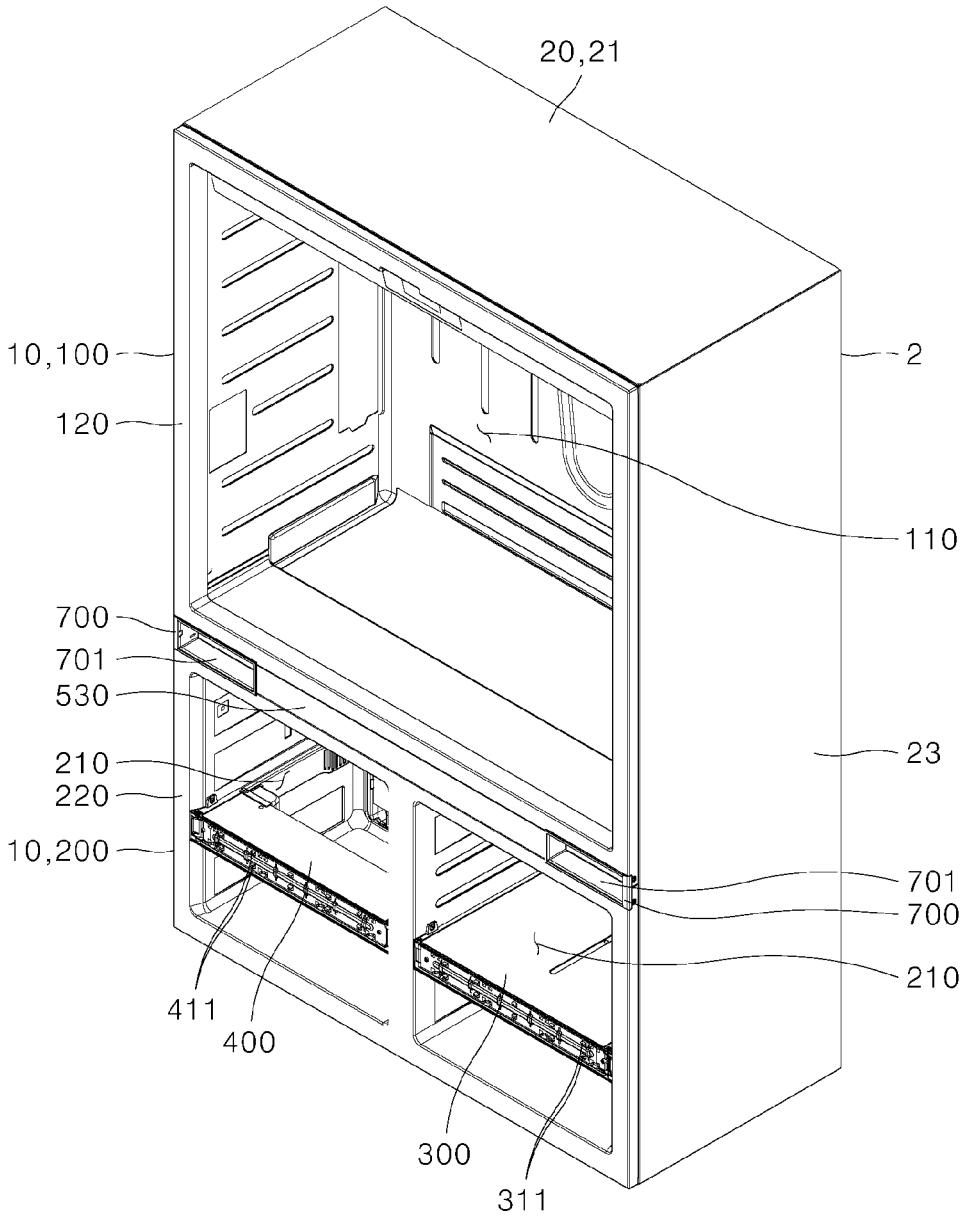
FIG. 2 is a front perspective view of a refrigerator in a state in which first doors and second doors are removed.
Figure 3:
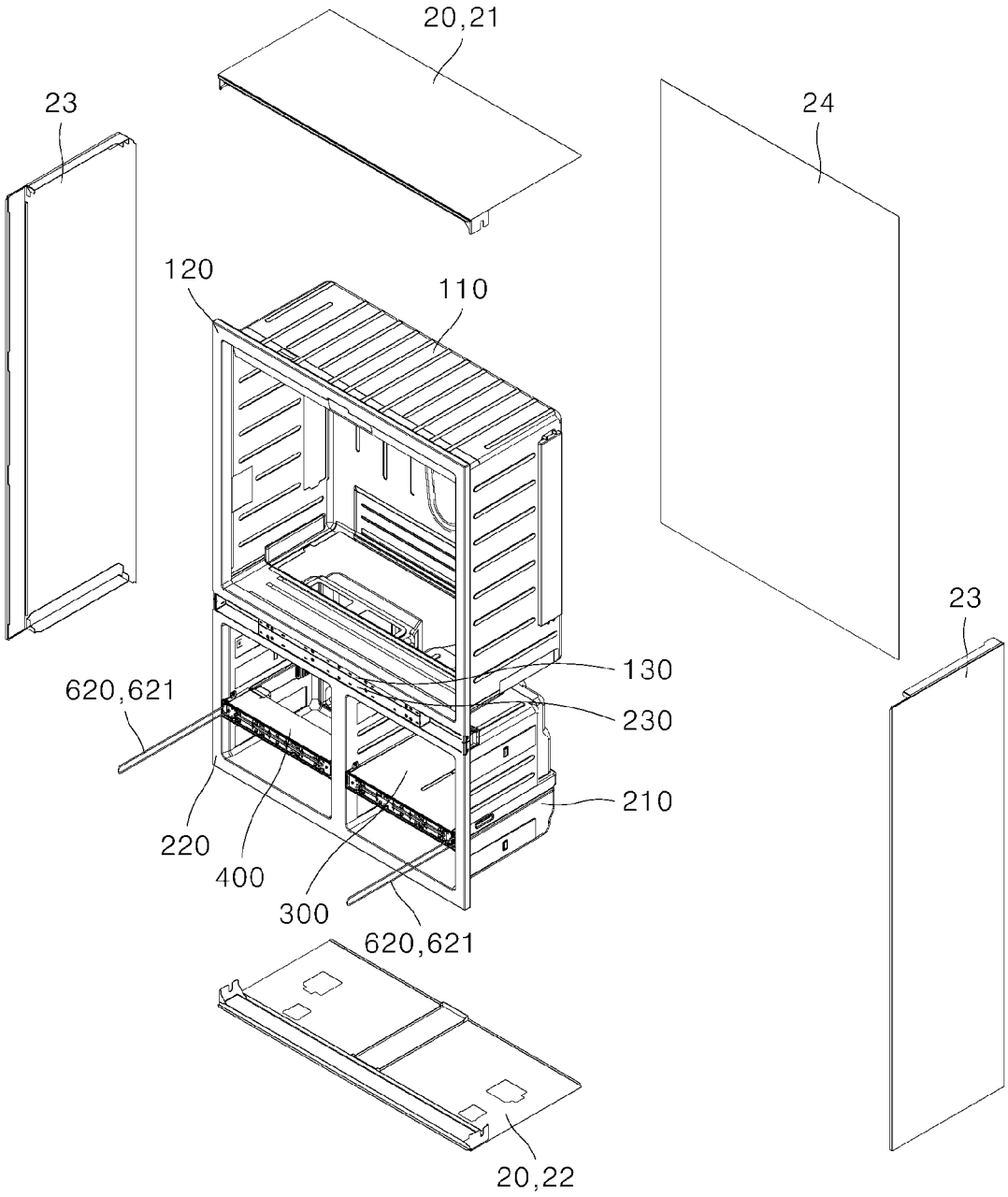
FIG. 3 is an exploded perspective view of a refrigerator in a state in which first doors and second doors are removed.

Referring to FIGS. 1 to 3, a refrigerator 1 according to one embodiment of the present disclosure and each of major components constituting the refrigerator 1 will be described.

An outer appearance of the refrigerator 1 may be formed by a cabinet 2 including one or more storage rooms 110 and 210, which are storage spaces for products, defined therein, and a plurality of doors 11 and 12 capable of opening and closing an open front surface of the cabinet 2.

The cabinet 2 may include an outer casing 20 and an inner casing 10 coupled to an inner side of the outer casing 20.

The cabinet 2 may be in a shape of a box with an open front surface, and may be divided into one or more storage spaces and include a refrigerating compartment and/or a freezer compartment.

The inner casing 10 may be disposed in a shape in which a first inner casing 100 is located at an upper portion and a second inner casing 200 is located at a lower portion thereof.

In this case, the first inner casing 100 may include at least one first storage room 110, and the first storage room 110 may be the refrigerating compartment. The second inner casing 200 may include at least one second storage room 210, and the second storage room 210 may be the freezer compartment.

However, the present disclosure is not limited thereto. The first storage room 110 may be the freezer compartment and the second storage room 210 may be the freezer compartment, and each of the freezer compartment and the refrigerating compartment may also be a variable storage room.

For example, the first inner casing 100 may include one first storage room 110, but the present disclosure may not be limited thereto.

In addition, a space of the second inner casing 200 may be divided by a partition 221 that partitions the space in a vertical direction near a central area such that a plurality of second storage rooms 210 are arranged side by side, but the present disclosure may not be limited thereto.

In addition, each of the plurality of second storage rooms 210 may include each of a first barrier 300 and a second barrier 400 that divides a space in a left and right direction near a center area thereof so as to be divided into a plurality of spaces again, but the present disclosure may not be limited thereto.

The first storage room 110 of the first inner casing 100 may be opened and closed by a pair of pivoting first doors 11 that pivot by hinges 30.

A pair of upper hinges 31 coupled to upper portions of the first doors 11 may be respectively seated in a pair of hinge seating portions 701 defined in both sides of a closing plate 800 located above the first storage room 110 and provide pivoting axes of the upper portions of the first door 11.

In addition, a pair of lower hinges 32 coupled to lower portions of the first doors 11 may be respectively seated in a pair of hinge seating portions 701 defined in both sides of a decor plate 530 located below the first storage room 110, that is, between the first storage room 110 and the second storage room 210, and provide pivoting axes of the lower portions of the first doors 11.

A hinge cover 700 may be disposed on a front surface of the hinge seating portion 701 to close the front surface of the hinge seating portion 701.

The second storage rooms 210 of the second inner casing 200 may be opened and closed by a plurality of drawer-type second doors 12 extended and retracted by rails.

It is shown in the present disclosure that the number of plurality of second doors 12 is four and the plurality of second doors 12 open and close the second storage room 210 including four storage compartments partitioned by the partition 221, the first barrier 300, and the second barrier 400, but the present disclosure is not limited thereto.

A rear surface, side surfaces, an upper surface, and a lower surface of the outer casing 20 may be formed as separate assemblies.

An outer casing rear wall 24 may be placed at rear surfaces of the first inner casing 100 and the second inner casing 200, outer casing side walls 23 may be placed at both side surfaces of the first inner casing 100 and the second inner casing 200, and an outer casing upper wall 21 and an outer casing lower wall 22 may be placed respectively at an upper surface of the first inner casing 100 and a lower surface of the second inner casing 200, so that the outer casing 20 may form outer surfaces excluding a front surface of the refrigerator 1.

The first inner casing 100 and the second inner casing 200 may be positioned to be inserted into the outer casing 20, but front surfaces thereof may be exposed to the outside to define an outer appearance of the front surface of the refrigerator 1.

The first inner casing 100 and the second inner casing 200 may be formed to be separated and distinguished from each other.

For example, each of the first inner casing 100 and the second inner casing 200 may be formed integrally by vacuum molding.

The first inner casing 100 may include the first storage room 110 defining at least one storage space and a first front wall 120 disposed to protrude outward along front edges located in front of the first storage room 110.

An outer diameter of the first front wall 120 is greater than an inner diameter of the first storage room 110, so that the first front wall 120 may be formed to protrude in a thin plate shape along outer edges of the first storage room 110.

The first inner casing 100 may include a first protrusion 130 protruding in one outward direction.

For example, the first protrusion 130 may be formed to protrude downward from the first front wall 120.

Herein, the downward direction means a direction toward the second inner casing 200.

The first protrusion 130 may be formed to protrude downward by extending in an elongated bar shape along a left and right direction of a front end of the first front wall 120 located at a bottom of the first inner casing 100.

The first protrusion 130 may extend in the left and right direction based on a center of the first inner casing 100, and may be formed to have a predetermined separation distance from each of both ends of the front end of the first front wall 120 located at the bottom of the first inner casing 100.

The second inner casing 200 may include the second storage room 210 defining at least one storage space and a second front wall 220 disposed to protrude outward along front edges located in front of the second storage room 210.

As described above, the space of the second inner casing 200 may be divided by the partition 221 that partitions the space in the vertical direction near the central area such that the plurality of second storage rooms 210 are distinguished from each other.

In this case, a front surface of the partition 221 may be flush with a front surface of the second front wall 220, and may be integrally formed with the same such that a boundary area between the partition 221 and the second front wall 220 is not recognized by a user when viewed from the front.

An outer diameter of the second front wall 220 is greater than an inner diameter of the plurality of second storage rooms 210, so that the second front wall 220 may be formed to protrude in a thin plate shape along outer edges of the second storage rooms 210.

The secondo inner casing 200 may include a second protrusion 230 protruding in one outward direction.

For example, the second protrusion 230 may be formed to protrude upward from the second front wall 220.

Herein, the upward direction means a direction toward the first inner casing 100.

The second protrusion 230 may be formed to protrude upward by extending in an elongated bar shape along a left and right direction of a front end of the second front wall 220 located at a top of the second inner casing 200.

The second protrusion 230 may extend in the left and right direction based on a center of the second inner casing 200, and may be formed to have a predetermined separation distance from each of both ends of the front end of the second front wall 220 located at the top of the second inner casing 200.

The first inner casing 100 and the second inner casing 200 may be located such that the first protrusion 130 and the second protrusion 230 face each other, and a coupling assembly (not shown) may be coupled to a rear surface of the first protrusion 130 and a rear surface of the second protrusion 230 to fix the first inner casing 100 and the second inner casing 200.

Hereinafter, with further reference to FIG. 4, the second inner casing 200, which is partitioned into the plurality of storage compartments including the first barrier 300 and the second barrier 400, will be described in more detail.

In the following, the second inner casing 200 will be named and described as the storage casing 200.

The storage casing 200 may include one or more storage compartments 211 and 212.

For example, the storage casing 200 may be divided by the partition 221 crossing the storage casing 200 in the vertical direction and include the first storage compartment 211 and the second storage compartment 212 disposed side by side in the left and right direction.

The storage casing 200 may be integrally formed by the vacuum molding, but the present disclosure may not be limited thereto.

In the first storage compartment 211, the first barrier 300 crossing the first storage compartment 211 in the left and right direction may be disposed.

The first barrier 300 may extend from a front surface of the first storage compartment 211 toward a rear surface thereof so as to be in contact with the rear surface of the first storage compartment 211.

Specifically, the first barrier 300 may be disposed so as to be in contact with both side surfaces and the rear surface of the first storage compartment 211.

Accordingly, the first storage compartment 211 may be partitioned and divided in the vertical direction such that storage spaces of a first upper storage compartment 2111 and a first lower storage compartment 2112 are distinguished from each other.

In one example, the second barrier 400 crossing the second storage compartment 212 in the left and right direction may be disposed within the second storage compartment 212.

The second barrier 400 may extend from a front surface of the second storage compartment 212 toward a rear surface thereof so as to be spaced apart from the rear surface of the second storage compartment 212.

Specifically, the second barrier 400 may be disposed so as to be in contact with both side surfaces of the second storage compartment 212 but spaced apart from the rear surface of the second storage compartment 212.

Accordingly, the second storage compartment 212 may be partitioned and divided in the vertical direction into a second upper storage compartment 2121 and a second lower storage compartment 2122 by the second barrier 400, and storage spaces of the second upper storage compartment 2121 and the second lower storage compartment 2122 may be in fluidly communication with each other without being separated from each other.

Figure 5:
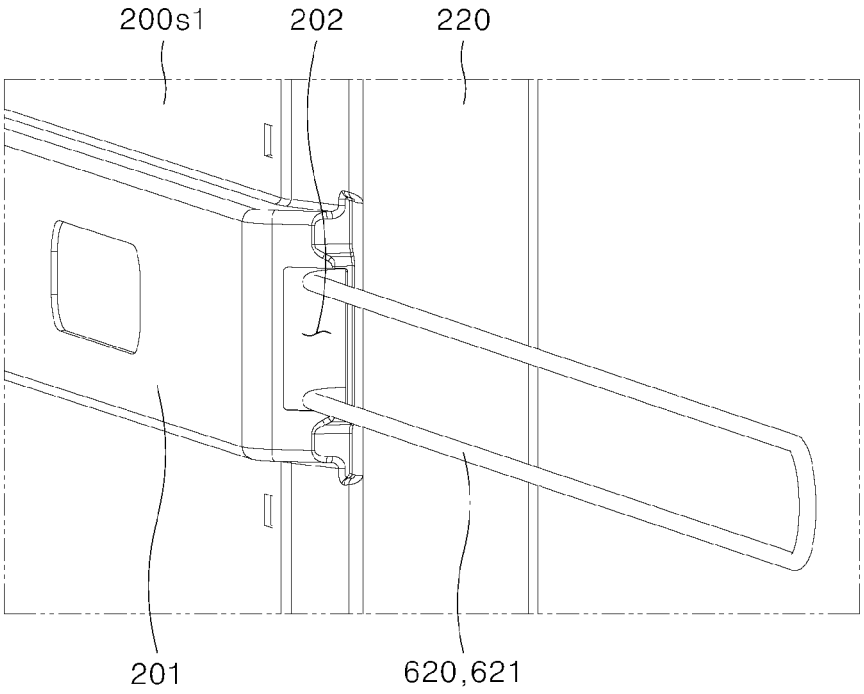
FIG. 5 is an enlarged view of a hot line outlet.

Referring further to FIG. 5, an elongated bar-shaped guide rail 201 protruding inward may be formed on an inner side of one side surface **200*s*1** of the storage casing.

The guide rail 201 may guide each of the first barrier 300 and the second barrier 400 to be inserted in a sliding manner in an inward direction from each of the front surfaces of the first storage compartment 211 and the second storage compartment 212.

Accordingly, a pair of guide rails 201 may be formed on respective inner sides of both side surfaces of the first storage compartment 211 and a pair of guide rails 201 may be formed on respective inner sides of both side surfaces of the second storage compartment 212.

A vertical dimension of the guide rail 201 is smaller than a vertical dimension of side surfaces of the first barrier 300 and the second barrier 400, so that the side surfaces of the first barrier 300 and the second barrier 400 may be inserted in the sliding manner in a form surrounding outer surfaces of the guide rails 201.

However, the present disclosure may not be limited thereto, and each guide rail 201 may be separated into upper and lower portions respectively supporting upper and lower portions of each side surface of each of the first barrier 300 and the second barrier 400.

In this case, the vertical dimension of the side surfaces of the first barrier 300 and the second barrier 400 may be smaller than a separation distance between the upper and lower portions of each guide rail 201 arranged in the vertical direction.

Accordingly, each of the first barrier 300 and the second barrier 400 may be inserted in the sliding manner in a shape in which the upper and lower portions of the side surface thereof are respectively surrounded by the upper and lower portions of the guide rail 201.

The side surfaces of the first barrier 300 and the second barrier 400 may have a shape compatible with each other so as to be inserted into the guide rail 201 formed in the first storage compartment 211 or the second storage compartment 212 in the sliding manner.

In the present disclosure, the first barrier 300 that is disposed to divide the upper storage space and the lower storage space of the storage compartment from each other is placed close to one side surface **200*s*1 of the storage casing, and the second barrier 400 that is disposed to allow the upper storage space and the lower storage space of the storage compartment to be in fluidly communication with each other without dividing those is disposed close to the other side surface 200*s*2** of the storage casing as an embodiment, but the present disclosure is not limited thereto.

For example, the second barrier 400 may be disposed in the first storage compartment 211 and the first barrier 300 may be disposed in the second storage compartment 212.

In addition, the first barrier 300 may be disposed in both the first storage compartment 211 and the second storage compartment 212, or the second barrier 400 may be disposed in both.

As such, the refrigerator according to the present disclosure may include the storage casing 200 including the plurality of storage compartments 211 and 212 arranged side by side in the left and right direction and include the plurality of barriers 300 and 400 respectively crossing the storage compartments 211 and 212 in the left and right direction, thereby implementing a 4-door drawer-type storage casing 200.

In addition, because the first barrier 300 and the second barrier 400 respectively partitioning the storage compartments are inserted in the sliding manner, ease of assembly is excellent.

In addition, because the first barrier 300 and the second barrier 400 may be inserted into the first storage compartment 211 or the second storage compartment 212 in the sliding manner so as to be compatible with each other, the positions of the first barrier 300 and the second barrier 400 may be easily changed and replaced as needed, so that structural change is very easy.

In one example, a hot line 620 may be disposed along a rear surface of the second front wall 220 of the storage casing 200, and a portion of the hot line 620 may extend inwardly of the storage casing 200 so as to overlap a front surface of each of the first barrier 300 and the second barrier 400.

Figure 4:
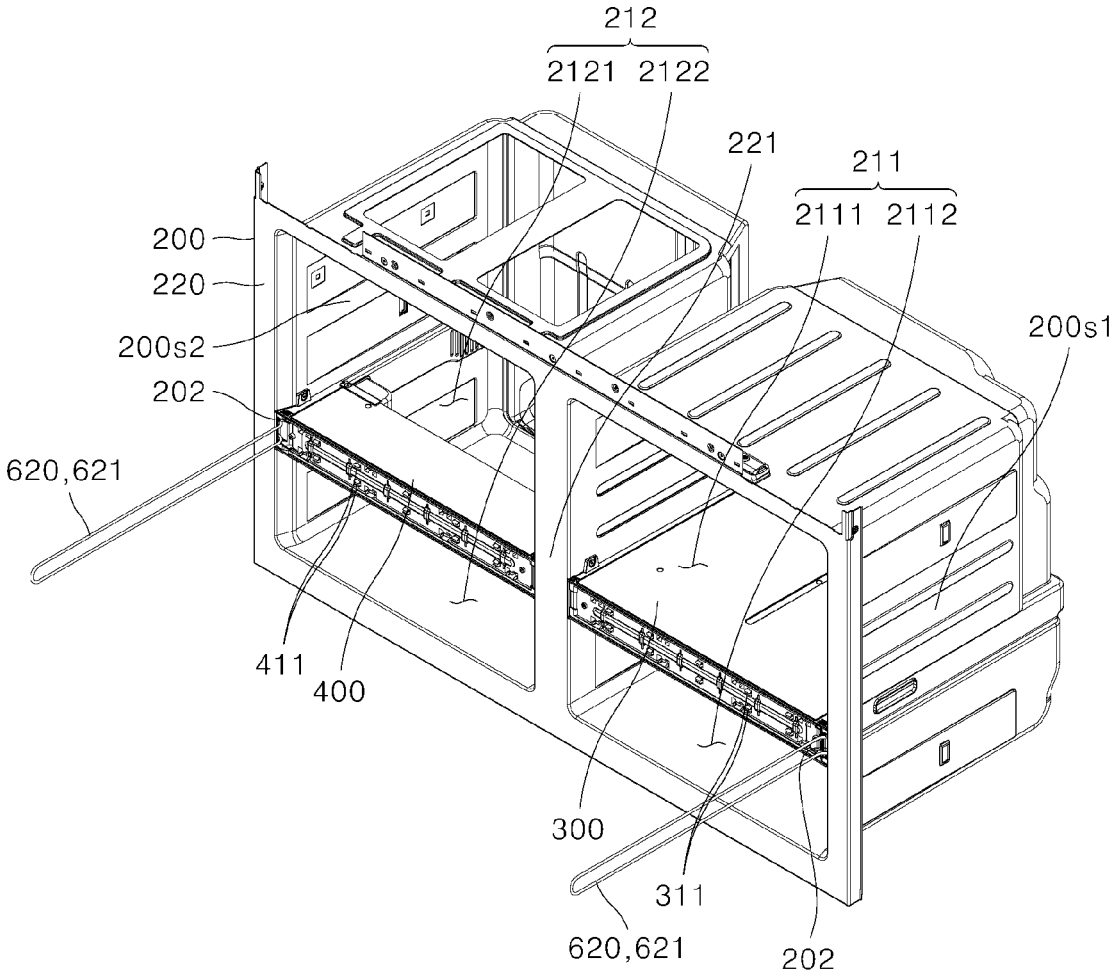
FIG. 4 is an enlarged front perspective view of a storage casing that is a second inner casing.

Referring to FIGS. 4 and 5, a pair of hot line outlets 202 through which hot line protrusions 621 of the hot lines 620 are withdrawn may be defined in a form of through-holes facing forward respectively in one side surface 200*s*1 of the storage casing in contact with the first barrier 300 and the other side surface 200*s*2 of the storage casing in contact with the second barrier 400.

In this case, the hot line outlet 202 may be defined at a front end of the guide rail 201, and may be positioned to overlap with the guide rail 201 with a vertical dimension smaller than the vertical dimension of the guide rail 201.

Therefore, in the state in which the first barrier 300 and the second barrier 400 are inserted into the first storage compartment 211 and the second storage compartment 212, respectively, the hot lines 620 may protrude forward in a form of passing through side surfaces of the first barrier 300 and the second barrier 400, respectively.

The hot line protrusions 621 protruding forward as such may be bent inwardly of the storage casing 200 via a bending process and respectively positioned on the front surfaces of the first barrier 300 and the second barrier 400.

FIG. 4 shows a state in which a first front plate 302 disposed on the front surface of the first barrier 300 and a second front plate 402 disposed on the front surface of the second barrier 400 are removed such that the hot lines 620 pass through the side surfaces of the first barrier 300 and the second barrier 400, respectively. The bending process of the hot line 620 and the first front plate 302 and the second front plate 402 will be described in detail below.

Figure 6:
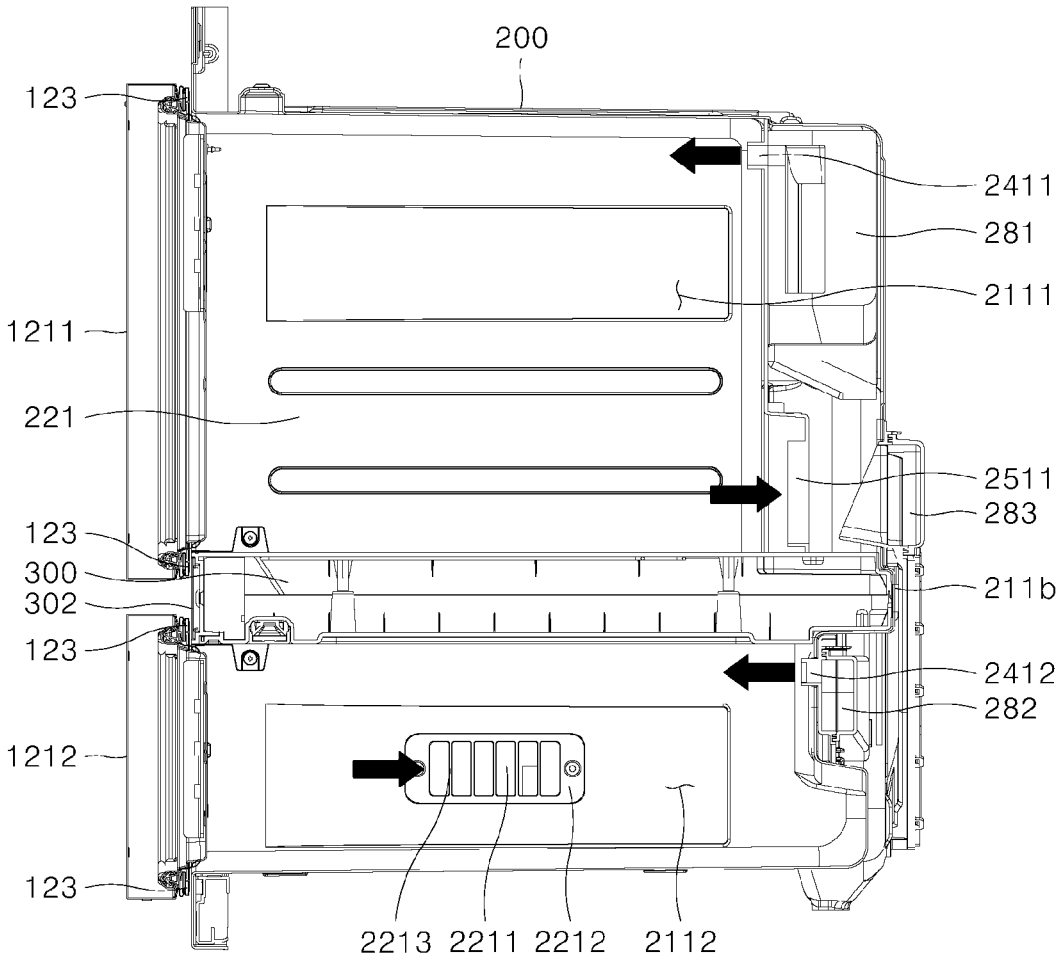
FIG. 6 is a cross-sectional view of a first storage compartment where first doors are installed and a first barrier.
Figure 7:
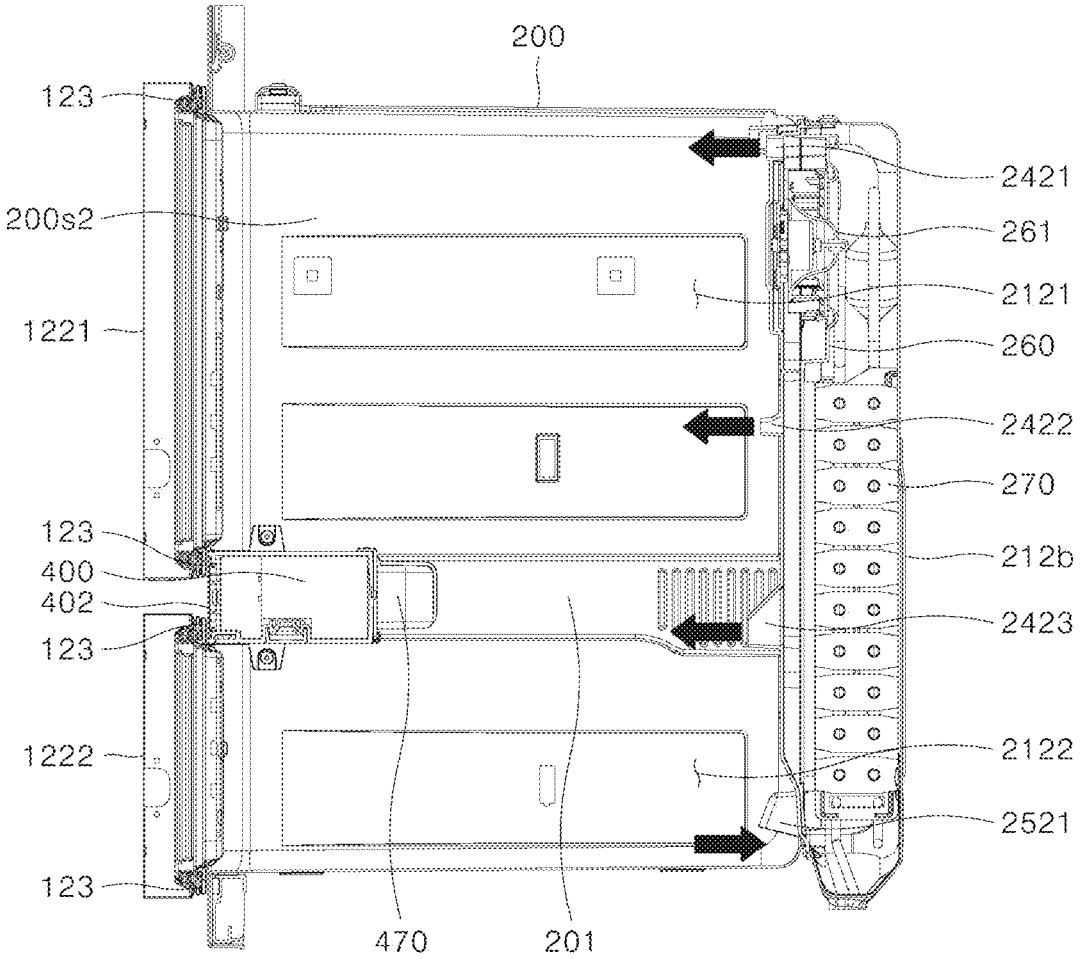
FIG. 7 is a cross-sectional view of a second storage compartment where second doors are installed and a second barrier.

FIG. 6 is a cross-sectional view of a first storage compartment where first doors are installed and a first barrier, and FIG. 7 is a cross-sectional view of a second storage compartment where second doors are installed and a second barrier.

An evaporator 270 that generates cool air and a blowing fan module 261 that supplies the cool air generated from the evaporator 270 to a cool air outlet or a cool air duct may be arranged on a rear surface of the storage casing 200.

A grille fan assembly 260 may be disposed on a front surface of the blowing fan module 261 to finish an inner appearance of the blowing fan module 261 and provide a flow path through which the cool air flows.

Although the present disclosure shows that the evaporator 270, the blowing fan module 261, and the grille fan assembly 260 are arranged on a second storage compartment rear surface 212*b* as an embodiment, the present disclosure is not limited thereto.

The cool air generated from the evaporator 270 may be discharged to a plurality of cool air outlets in the second storage compartment 212 via the blowing fan module 261.

For example, the second storage compartment 212 may be divided into the second upper storage compartment 2121 and the second lower storage compartment 2122 by the second barrier 400.

In this case, a second-first cool air outlet 2421 may be defined in an upper area and a second-second cool air outlet 2422 may be defined in a lower area of the second upper storage compartment 2121 so as to discharge the cool air generated from the evaporator 270 into the second upper storage compartment 2121.

In addition, a second-third cool air outlet 2423 may be defined in an upper area of the second lower storage compartment 2122 so as to discharge the cool air generated from the evaporator 270 to the second lower storage compartment 2122.

A second-first cool air recovery port 2521 for recovering the cool air discharged to the second storage compartment 212 may be defined in a lower area of the second lower storage compartment 2122.

As described above, because the second barrier 400 is disposed to be spaced apart from the second storage compartment rear surface 212*b* to allow the second upper storage compartment 2121 and the second lower storage compartment 2122 to be in fluidly communication with each other, the cool air circulating through the second upper storage compartment 2121 and the second lower storage compartment 2122 may be shared with each other.

Therefore, as the cool air discharged via the second-first cool air outlet 2421, the second-second cool air outlet 2422, and the second-third cool air outlet 2423 is recovered via the second-first cool air recovery port 2521, the cool air may be evenly circulated throughout the second upper storage compartment 2121 and the second lower storage compartment 2122.

That is, the cool air circulating through the second upper storage compartment 2121 and the second lower storage compartment 2122 may be discharged to the same cool air outlet and recovered via the same cool air recovery port.

Accordingly, the second upper storage compartment 2121 and the second lower storage compartment 2122 may be controlled at the same temperature as each other, and the second upper storage compartment 2121 and the second lower storage compartment 2122 may be used as the freezer compartments.

In one example, the cool air generated from the evaporator 270 disposed on the second storage compartment rear surface 212*b* may flow to a first cool air duct 281 and a second cool air duct 282 via the blowing fan module 261 and be supplied to the first storage compartment 211.

For example, the first storage compartment 211 may be divided into the first upper storage compartment 2111 and the first lower storage compartment 2112 by the first barrier 300.

In this case, the first cool air duct 281 including a first-first cool air outlet 2411 may be disposed at an upper area of the first upper storage compartment 2111 to discharge the cool air generated from the evaporator 270 to the first upper storage compartment 2111.

A first-first cool air recovery port 2511 may be defined in a lower area of the first upper storage compartment 2111 to recover the cool air circulating through the first upper storage compartment 2111.

The cool air recovered via the first-first cool air recovery port 2511 may be supplied to the evaporator 270 again via a recovery duct 283 disposed on a rear surface of the first-first cool air recovery port 2511.

In one example, the second cool air duct 282 including a first-second cool air outlet 2412 may be disposed in an upper area of the first lower storage compartment 2112 to discharge the cool air generated from the evaporator 270 to the first lower storage compartment 2112.

A cool air recovery communication-hole 2211 that allows the first lower storage compartment 2112 and the second lower storage compartment 2122 to be in fluidly communication with each other may be defined in a lower area of the partition 221 for dividing the first storage compartment 211 and the second storage compartment 212 from each other.

The cool air recovery communication-hole 2211 may be defined to extend through the partition 221.

A communication-hole cover 2212 including a plurality of guide ribs 2213 spaced apart from each other at a predetermined spacing may be disposed on the cool air recovery communication-hole 2211.

The guide rib 2213 of the communication-hole cover 2212 may adjust a direction of the cool air recovered from the first lower storage compartment 2112 to the second lower storage compartment 2122, and may prevent stored objects in the first lower storage compartment 2112 and the second lower storage compartment 2122 from being transferred to the opposite storage compartment.

As described above, because the first barrier 300 is disposed to be in contact with the first storage compartment rear surface 211*b*, the first upper storage compartment 2111 and the first lower storage compartment 2112 may be physically separated from each other.

Accordingly, the cool air discharged to the first upper storage compartment 2111 via the first-first cool air outlet 2411 may be recovered via the first-first cool air recovery port 2511.

In addition, the cool air discharged to the first lower storage compartment 2112 via the first-second cool air outlet 2412 may flow to the second lower storage compartment 2122 via the cool air recovery communication-hole 2211 and then be recovered via the second-first cool air recovery port 2521.

That is, the cool air circulating through the first upper storage compartment 2111 and the cool air circulating through the first lower storage compartment 2112 may be discharged via the different air outlets and recovered via the different cool air recovery ports.

Accordingly, the first upper storage compartment 2111 and the first lower storage compartment 2112 may be controlled at different temperatures.

Because the first lower storage compartment 2112, the second upper storage compartment 2121, and the second lower storage compartment 2122 share the circulating cool air, they may be controlled at the same temperature as each other and may be used as the freezer compartments.

In this case, the first upper storage compartment 2111 may also be used as the freezer compartment, but may be used as the refrigerating compartment because the cool air circulation is not shared with other storage compartments.

That is, the first upper storage compartment 2111 may be used as a convertible-type storage compartment whose purpose is changed between the freezer compartment and the refrigerating compartment based on a user's choice.

For example, a damper controlled by a controller may be disposed in the first cool air duct 281 so as to adjust an amount of cool air supplied, so that the switch between the freezer compartment and the refrigerating compartment may be freely performed based on the user's choice.

As described above, in the refrigerator 1 according to the present disclosure, the cool air respectively circulating through the plurality of storage compartments partitioned by the barrier are discharged and recovered via the different cool air outlets and the different cool air recovery ports, thereby independently controlling temperatures of the plurality of storage compartments.

Therefore, there is an advantage in that the specific storage compartment may be freely switched into the freezer compartment or the refrigerating compartment based on the user's choice.

The first upper storage compartment 2111, the first lower storage compartment 2112, the second upper storage compartment 2121, and the second lower storage compartment 2122 may be respectively opened and closed by a first-first door 1211, a first-second door 1212, a second-first door 1221, and a second-second door 1222, which are the drawer-type doors.

For example, gasket magnets 123 in contact with the front surface of the first barrier 300 may be disposed on a rear surface of the first-first door 1211 and a rear surface of the first-second door 1212 along edges thereof.

The gasket magnet 123 may be formed in a shape in which the gasket magnet 123 having a magnetic component is inserted into a gasket that seals between the door and the front surface of the refrigerator, but may not be limited thereto, and the gasket itself may be made of a material having the magnetic component.

The first front plate 302 containing a metal material such as an iron plate may be disposed on the front surface of the first barrier 300.

Accordingly, the gasket magnet 123 of the first-first door 1211 may be in contact with an upper area of the first front plate 302 located on the front surface of the first barrier 300 and the gasket magnet 123 of the first-second door 1212 may be in contact with a lower area of the first front plate 302 located on the front surface of the first barrier 300 so as to seal the cool air inside the refrigerator 1.

In addition, the gasket magnets 123 in contact with the front surface of the second barrier 400 may be disposed on a rear surface of the second-first door 1221 and a rear surface of the second-second door 1222 along edges thereof.

A second front plate 402 containing the metal material such as the iron plate may be disposed on the front surface of the second barrier 400.

Accordingly, the gasket magnet 123 of the second-first door 1221 may be in contact with an upper area of the second front plate 402 located on the front surface of the second barrier 400 and the gasket magnet 123 of the second-second door 1222 may be in contact with a lower area of the second front plate 402 located on the front surface of the second barrier 400 so as to seal the cool air inside the refrigerator 1.

As described above, the refrigerator according to the present disclosure may also perform the function of sealing the cool air inside the refrigerator by placing the barrier containing the metal material at a position corresponding to the front door including the gasket magnet.

Figure 8:
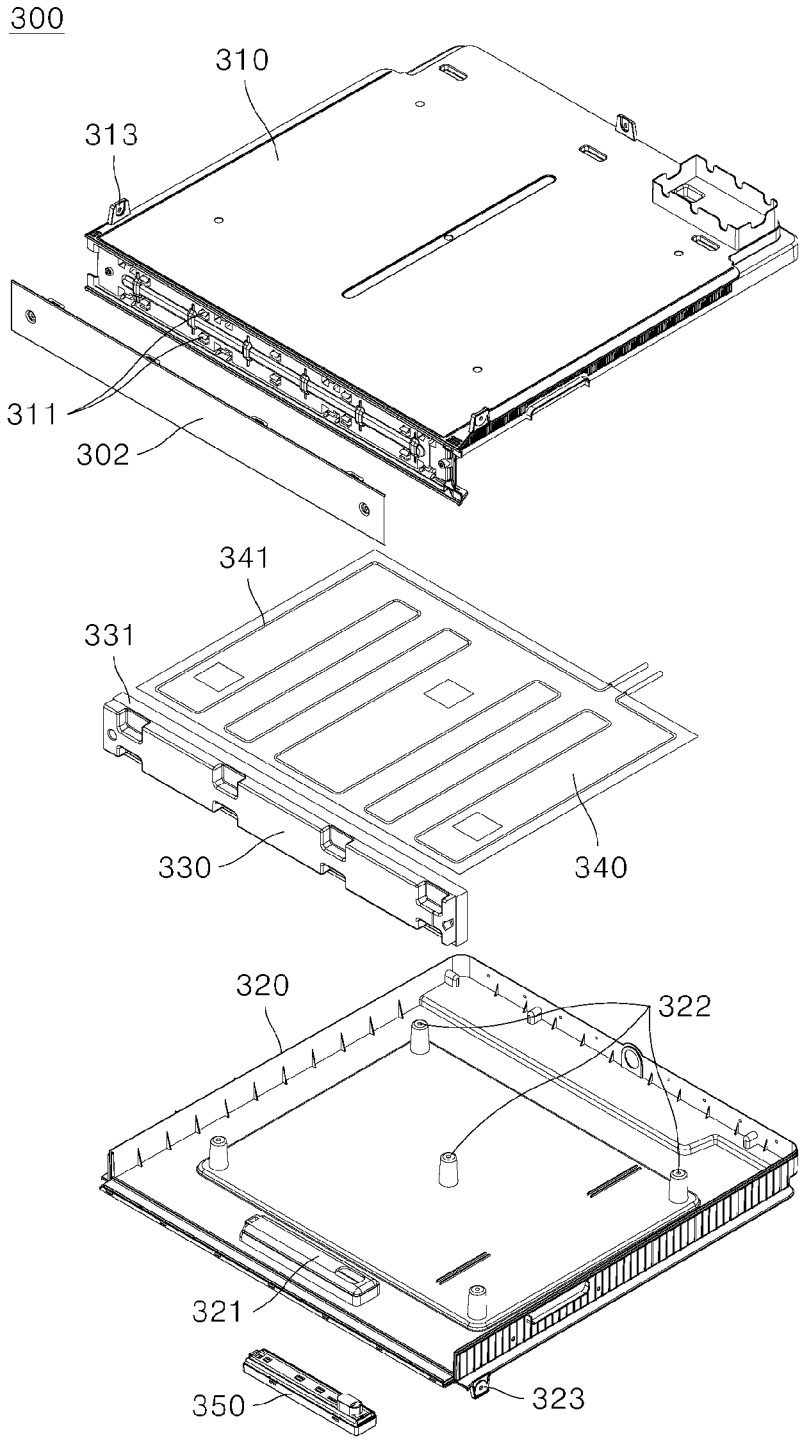
FIG. 8 is an exploded perspective view of a first barrier.
Figure 9:
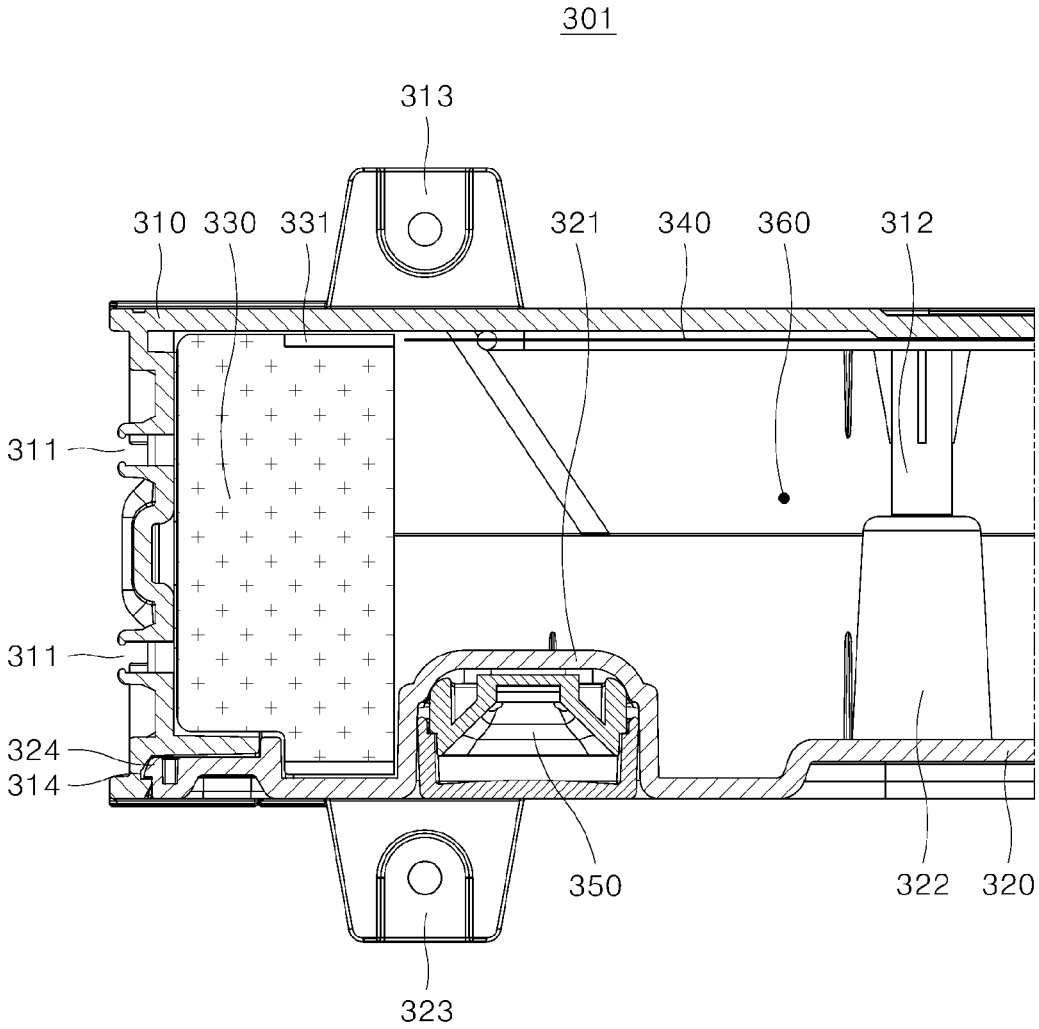
FIG. 9 is a cross-sectional view of a front area of a first barrier.
Figure 10:
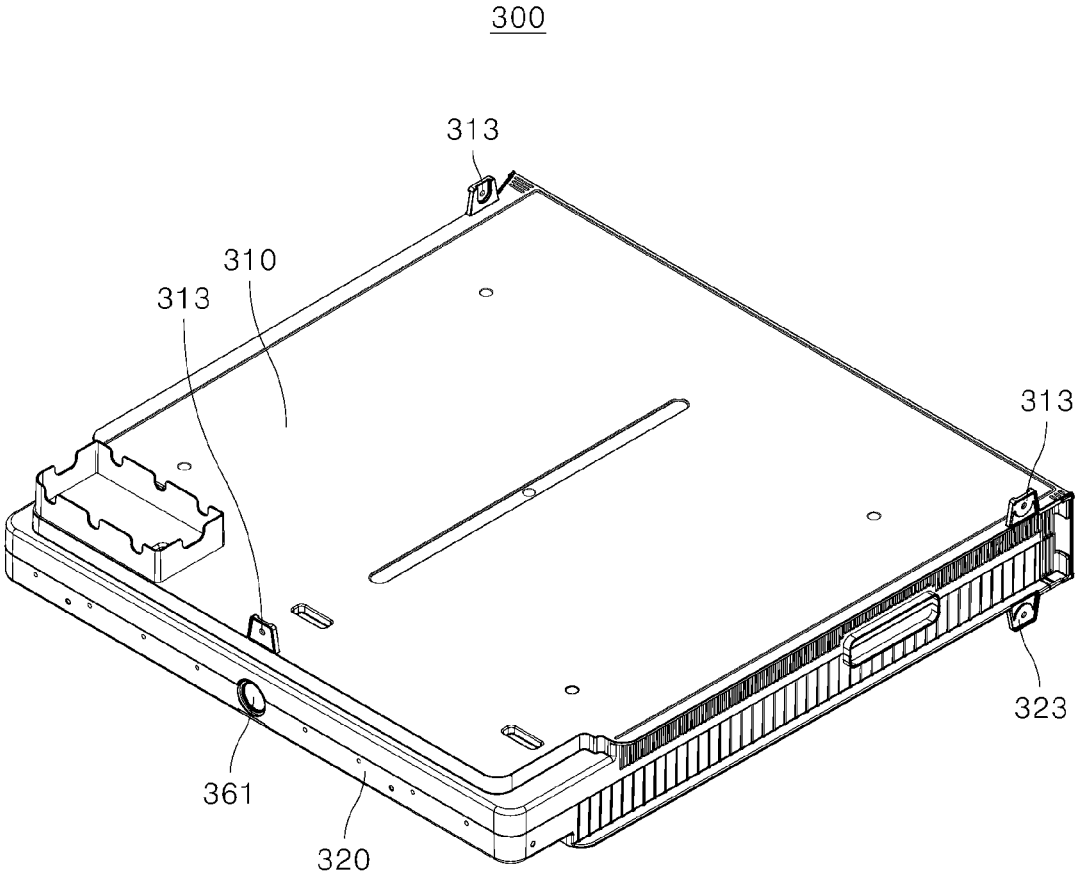
FIG. 10 is a perspective view of a rear surface of a first barrier.
Figure 11:
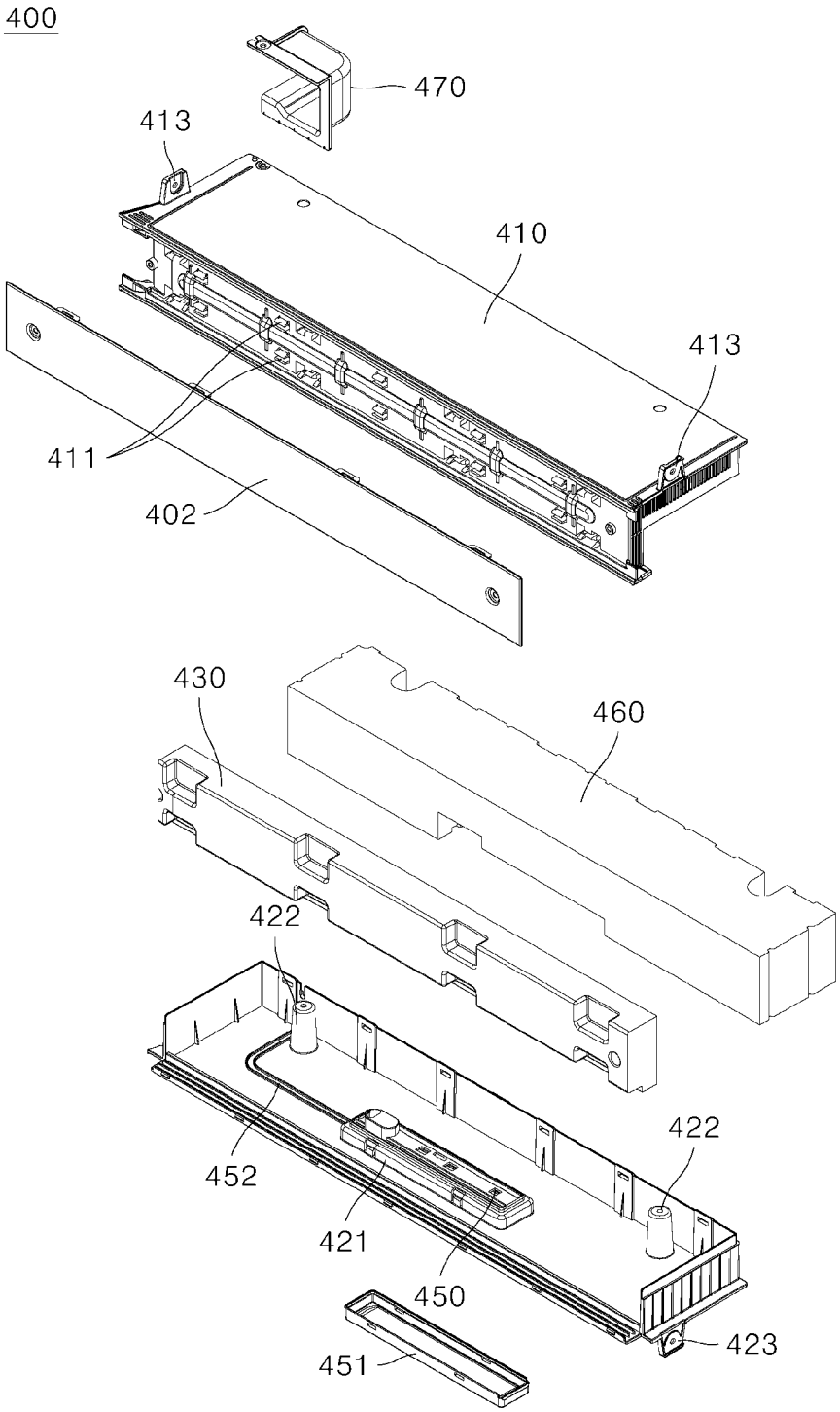
FIG. 11 is an exploded perspective view of a second barrier.
Figure 12:
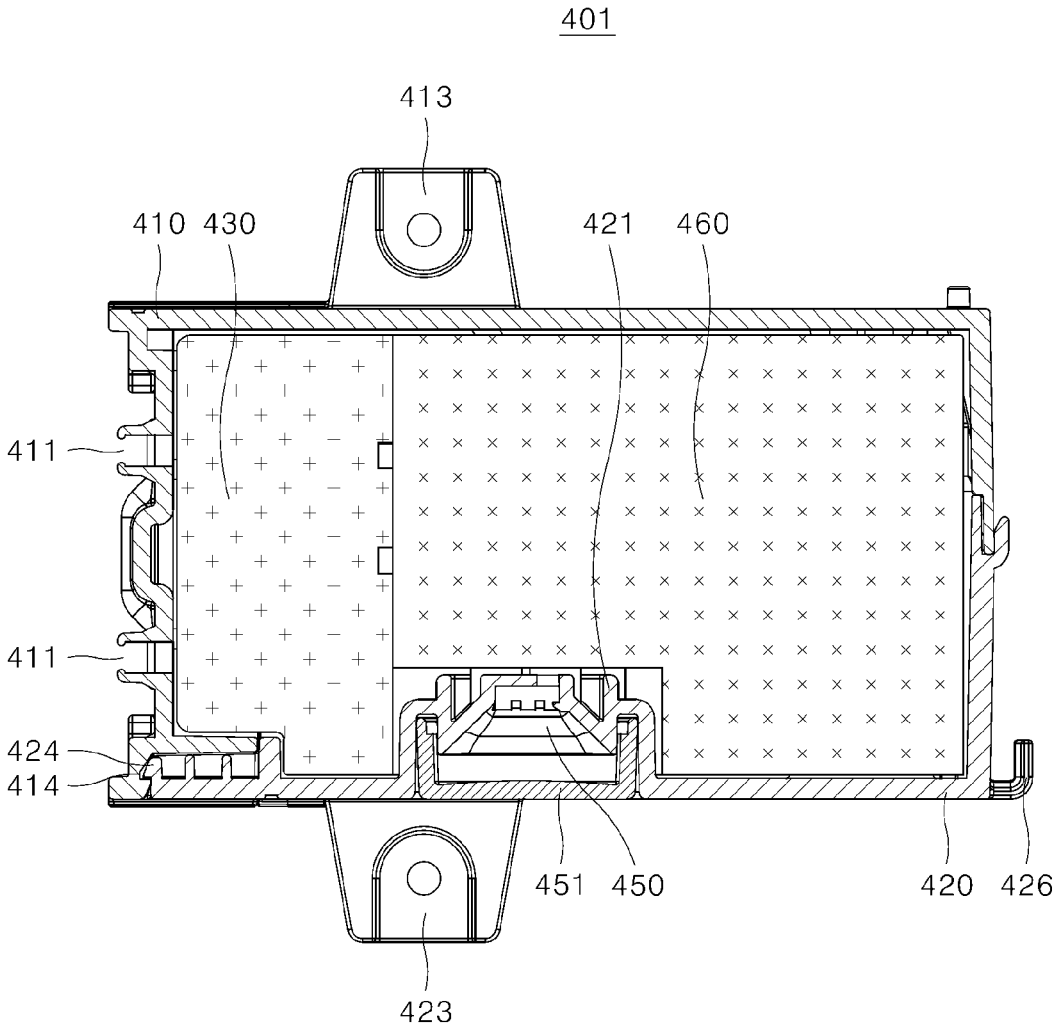
FIG. 12 is a cross-sectional view of a second barrier including an insulator.
Figure 13:
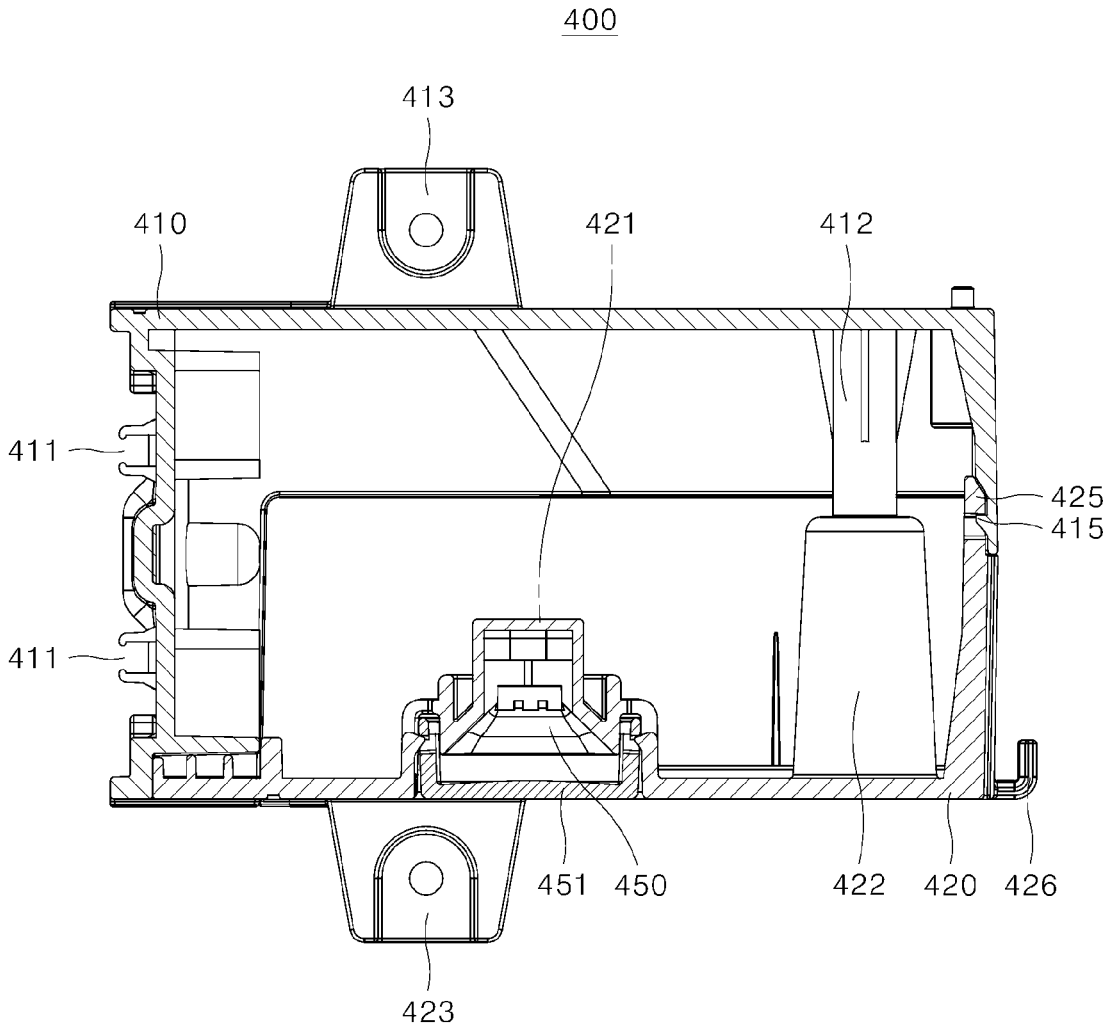
FIG. 13 is a cross-sectional view of a second barrier from which an insulator is removed.

Hereinafter, the first barrier 300 will be described in detail with reference to FIGS. 8 to 10.

The first barrier 300 may include a first body 301 constituting an overall outer appearance and the first front plate 302 disposed on a front surface of the first body 301.

For ease of assembly, the first front plate 302 may be disposed on the front surface of the first body 301 using a fastening structure such as a hook or a screw.

As described above, the first front plate 302 may contain the metal material so as to be strongly fixed to the gasket magnet 123 of the door to seal the internal cool air of the refrigerator 1.

In addition, the first front plate 302 may serve to conceal and fix the hot line 620 disposed along the front surface of the first body 301.

The first body 301 may be formed in a shape of being in contact with both side surfaces of the first storage compartment 211 and extending from the front surface to the rear surface so as to divide the upper and lower portions of the first storage compartment 211 as the separate storage spaces.

Accordingly, a length of the first body 301 in the left and right direction may be substantially similar to an inner diameter of the first storage compartment 211 in the left and right direction, and a length of the first body 301 in a front and rear direction may be substantially similar to an inner diameter of the first storage compartment 211 in the front and rear direction.

The first body 301 may be constructed in a shape in which a first upper plate 310 forming an upper surface, a front surface, and partial side surfaces and a first lower plate 320 forming a lower surface, a rear surface, and partial side surfaces are coupled to each other.

A plurality of first upper plate fixing portions 313 protruding upward may be formed on both side surfaces and the rear surface of the first upper plate 310 so as to fix the first barrier 300 with a fastening member such as a screw inside the first storage compartment 211.

In addition, a plurality of first lower plate fixing portions 323 protruding downward are formed on both side surfaces of the first lower plate 320 so as to fix the first barrier 300 with the fastening member such as the screw inside the first storage compartment 211.

The first upper plate 310 and the first lower plate 320 may be coupled to each other such that a first upper plate fastening portion 312 and a first lower plate fastening portion 322 respectively formed inside the first upper plate 310 and the first lower plate 320 at positions corresponding to each other so as to face each other are fixed by the fastening member such as the screw.

In addition, a first hook fastening portion 314 may be formed at a lower end of a front surface of the first upper plate 310 and a first hook 324 may be formed at a front end of a lower surface of the first lower plate 320, so that the first upper plate 310 and the first lower plate 320 may be hooked together at front ends thereof.

A plurality of first clips 311 fixing the hot line 620 in a clip fixing manner may be arranged on the front surface of the first upper plate 310.

In the present disclosure, it is shown as an embodiment that the plurality of first clips 311 are arranged in upper and lower two rows in a divided manner so as to be spaced apart from each other by a predetermined distance, but the present disclosure is not limited thereto. An arrangement of the first clips may be changed based on an arrangement form of the hot line 620.

In one example, the first body 301 may include a plate-shaped heat plate 340 in which a heat wire 341 is disposed.

The heat plate 340 may be disposed on an upper rear surface of the first upper plate 310.

As described above, the first upper storage compartment 2111 located above the first barrier 300 may be operated in a form in which the refrigerating compartment and the freezer compartment are switchable.

In this case, when the first upper storage compartment 2111 is switched into the refrigerating compartment, frost may occur inside the first upper storage compartment 2111 because of a temperature difference with other adjacent storage compartments operated as the freezer compartments. Therefore, the heat plate 340 may be positioned as close to the first upper storage compartment 2111 as possible to remove the frost.

However, the present disclosure may not be limited thereto, and the heat plate 340 may be disposed along an inner lower surface of the first barrier 300, or may be disposed on both inner upper surface and lower surface.

A first lighting accommodating portion 321 may be formed at a front area of the first lower plate 320, and a first lighting 350 such as an LED may be disposed in the first lighting accommodating portion 321.

As the first lighting 350 is disposed on the first lower plate 320 as such, when the first-second door 1212 is opened, the first lighting 350 may emit light downward to illuminate the first lower storage compartment 2112 located below.

In the case of the first storage compartment 211, because the upper and lower storage compartments are divided by the first barrier 300, it is preferable that the lighting of the first upper storage compartment 2111 and the first lower storage compartment 2112 are separately disposed and controlled.

As such, in the refrigerator according to the present disclosure, the barrier for dividing the storage compartment of the storage casing in the vertical direction includes the lighting, so that it is not necessary to secure separate space for installing the lighting in the storage casing, thereby increasing space utilization.

A first front insulator 330 may be disposed on a front surface of the first body 301.

The first front insulator 330 may be formed to extend along the left and right direction of the first body 301, but may be formed with a small width in the front and rear direction so as to be formed only in a partial section of the front area.

For example, the first front insulator 330 may be disposed between the front surface of the first body 301 and the first lighting accommodating portion 321.

A foam insulator 360 such as polyurethane may be filled in a rear area of the first body 301 where the first front insulator 330 is not disposed.

The foam insulator 360 may be injected into the barrier in a form of a foam liquid via an injection hole 361 in a state in which the first body 301 is assembled.

When the first upper storage compartment 2111 and the first lower storage compartment 2112 are used as the refrigerating compartment and the freezer compartment, respectively, the first barrier 300 filled with the foam insulator 360 may increase an insulation performance of insulating both storage compartments from each other.

In this case, because a sealing foam 331 is formed along an edge of the first front insulator 330, leakage of the foam liquid for forming the foam insulator 360 may be prevented as much as possible.

Hereinafter, the second barrier 400 will be described in detail with reference to FIGS. 11 to 14.

The second barrier 400 may include a second body 401 constituting an overall outer appearance and the second front plate 402 disposed on a front surface of the second body 401.

For ease of assembly, the second front plate 402 may be disposed on the front surface of the second body 401 using the fastening structure such as the hook or the screw.

As described above, the second front plate 402 may contain the metal material so as to be strongly fixed to the gasket magnet 123 of the door to seal the internal cool air of the refrigerator 1.

In addition, the second front plate 402 may serve to conceal and fix the hot line 620 disposed along the front surface of the second body 401.

The second body 401 may be formed in a shape of being in contact with both side surfaces of the second storage compartment 212 but not extending from the front surface to an end of the rear surface thereof so as to divide only a front area of the second storage compartment 212 in the vertical direction.

Accordingly, a length of the second body 401 in the left and right direction may be substantially similar to an inner diameter of the second storage compartment 212 in the left and right direction, and a length of the second body 401 in the front and rear direction may be smaller than an inner diameter of the second storage compartment 212 in the front and rear direction.

The second body 401 may be constructed in a shape in which a second upper plate 410 forming an upper surface, a front surface, partial side surfaces, and a partial rear surface, and a second lower plate 420 forming a lower surface, partial side surfaces, and a partial rear surface are coupled to each other.

A second upper plate fixing portion 413 may be formed to fix the second barrier 400 with the fastening member such as the screw inside the second storage compartment 212.

In addition, a plurality of second lower plate fixing portions 423 protruding downward are formed on both side surfaces of the second lower plate 420 so as to fix the second barrier 400 with the fastening member such as the screw inside the second storage compartment 212.

The second upper plate 410 and the second lower plate 420 may be coupled to each other such that a second upper plate fastening portion 412 and a second lower plate fastening portion 422 respectively formed inside the second upper plate 410 and the second lower plate 420 at positions corresponding to each other so as to face each other are fixed by the fastening member such as the screw.

In addition, a second front hook fastening portion 414 may be formed at a lower end of a front surface of the second upper plate 410 and a second front hook 424 may be formed at a front end of a lower surface of the second lower plate 420, so that the second upper plate 410 and the second lower plate 420 may be hooked together at front ends thereof.

In addition, a second rear hook fastening portion 425 may be formed at a lower end of a rear surface of the second upper plate 410 and a second rear hook 415 may be formed at an upper end of a rear surface of the second lower plate, so that the second upper plate 410 and the second lower plate 420 may be hooked together at rear ends thereof.

A plurality of second clips 411 for fixing the hot line 620 in a clip fixing manner may be disposed on the front surface of the second upper plate 410.

In the present disclosure, it is shown as an embodiment that the plurality of second clips 411 are arranged in upper and lower two rows in a divided manner so as to be spaced apart from each other by a predetermined distance, but the present disclosure is not limited thereto. An arrangement of the second clips may be changed based on an arrangement form of the hot line 620.

A second lighting accommodating portion 421 may be formed at a front area of the second lower plate 420, and a second lighting 450 such as the LED and a lighting cover 451 for covering the second lighting 450 may be disposed in the second lighting accommodating portion 421.

As the second lighting 450 is disposed on the second lower plate 420 as such, when the second-second door 1222 is opened, the second lighting 450 may emit light downward to illuminate the second lower storage compartment 2122 located below.

In the case of the second storage compartment 212, although the upper and lower storage compartments are not completely divided by the second barrier 400, considering that a size of the second storage compartment 212 is increasing, it is preferable that the lighting of the second upper storage compartment 2121 and the second lower storage compartment 2122 are separately disposed and controlled.

As such, in the refrigerator according to the present disclosure, the barrier for dividing the storage compartment of the storage casing in the vertical direction includes the lighting, so that it is not necessary to secure separate space for installing the lighting in the storage casing, thereby increasing space utilization.

A second front insulator 430 may be disposed on a front surface of the second body 401.

The second front insulator 430 may be formed to extend along the left and right direction of the second body 401, but may be formed with a small width in the front and rear direction so as to be formed only in a partial section of the front area.

For example, the second front insulator 430 may be disposed between the front surface of the second body 401 and the second lighting accommodating portion 421.

A second rear insulator 460 may be filled in a rear area of the second body 401 where the second front insulator 430 is not disposed.

As such, the insulator disposed inside the second body 401 is divided into the second front insulator 430 and the second rear insulator 460 and assembled, thereby increasing the ease of assembly.

Figure 14:
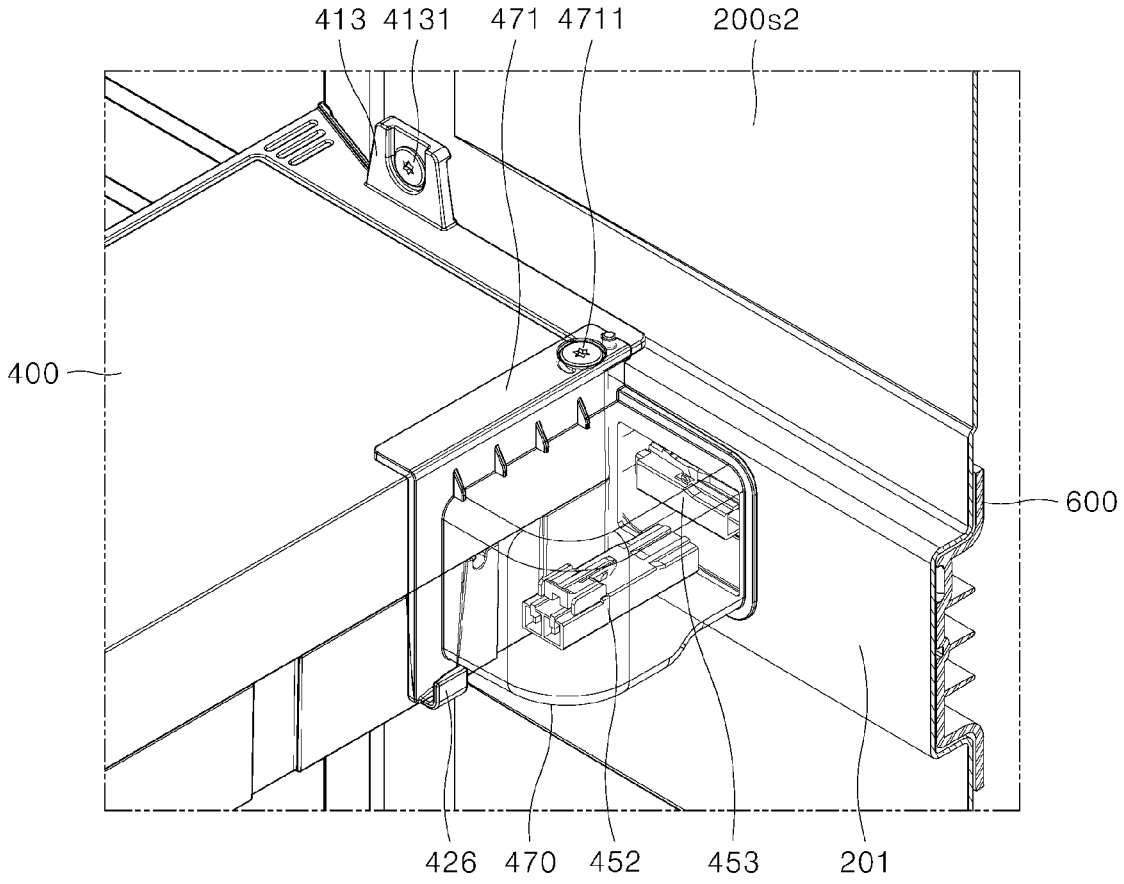
FIG. 14 shows a cap cover disposed on a rear surface of a second barrier at a location between the second barrier and a second storage compartment.

Referring to FIG. 14, the second upper plate fixing portion 413 of the second barrier 400 inserted along the guide rail 201 may be fixed to the other side surface **200*s*2 of the storage casing by a fastening member 4131**.

A lighting harness 452 connected to the second lighting 450 may protrude from the rear surface of the second barrier 400.

The lighting harness 452 may be connected to a harness connector 453 via a through-hole defined in the other side surface **200*s*2 of the storage casing located on the rear surface of the second barrier 400** to receive power and control signals.

Accordingly, a cap cover 470 for covering a partial area of the rear surface of the second barrier 400 and an inner partial area of the other side surface 200s2 of the storage casing may be disposed on the rear surface of the second barrier 400.

The cap cover 470 may serve as a housing providing sufficient space to accommodate the lighting harness 452.

An upper side of the cap cover 470 may include a bent portion 471 bent forward and seated on the upper surface of the second barrier 400, and the bent portion 471 may be fixed to the upper surface of the second barrier 400 by a fastening member 4711.

In addition, a hooking portion 426 protruding rearward and bent upward is formed at a bottom of the second barrier 400 to support the cap cover 470 from below.

A supporter housing 600 may be disposed on an outer side of the other side surface of the storage casing 200s2.

Figure 15:
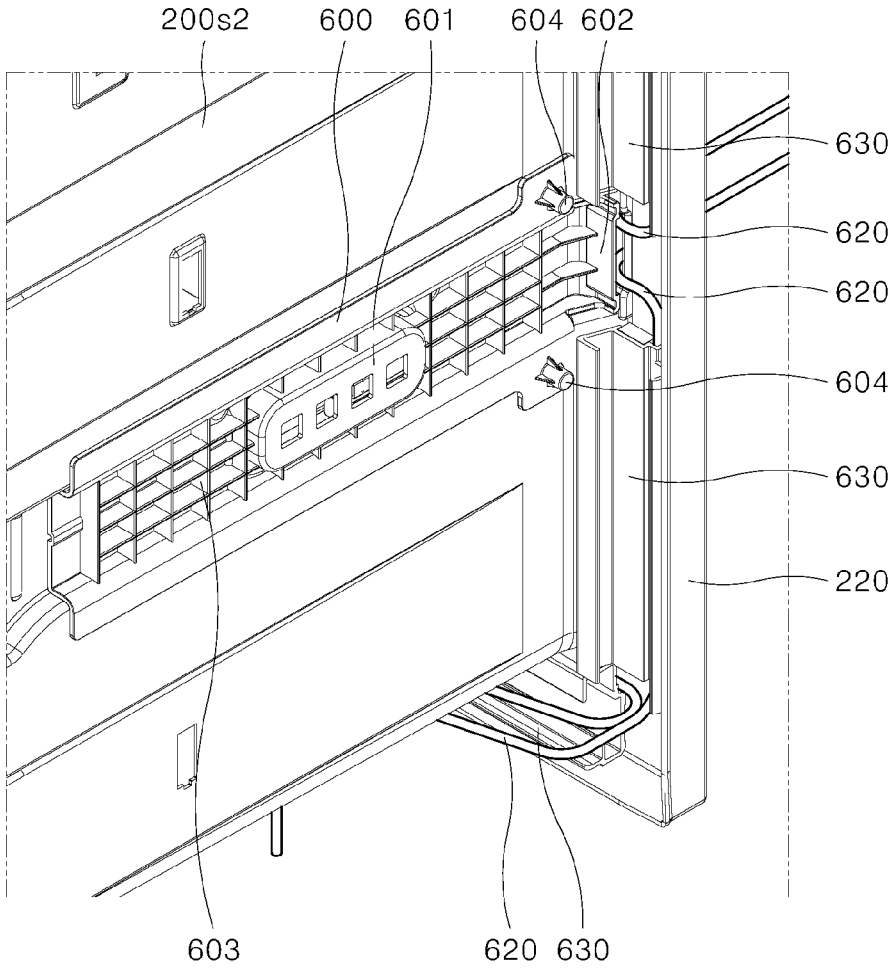
FIG. 15 shows a supporter housing disposed on an outer side of the other side surface of a storage casing where a second barrier is disposed.
Figure 16:
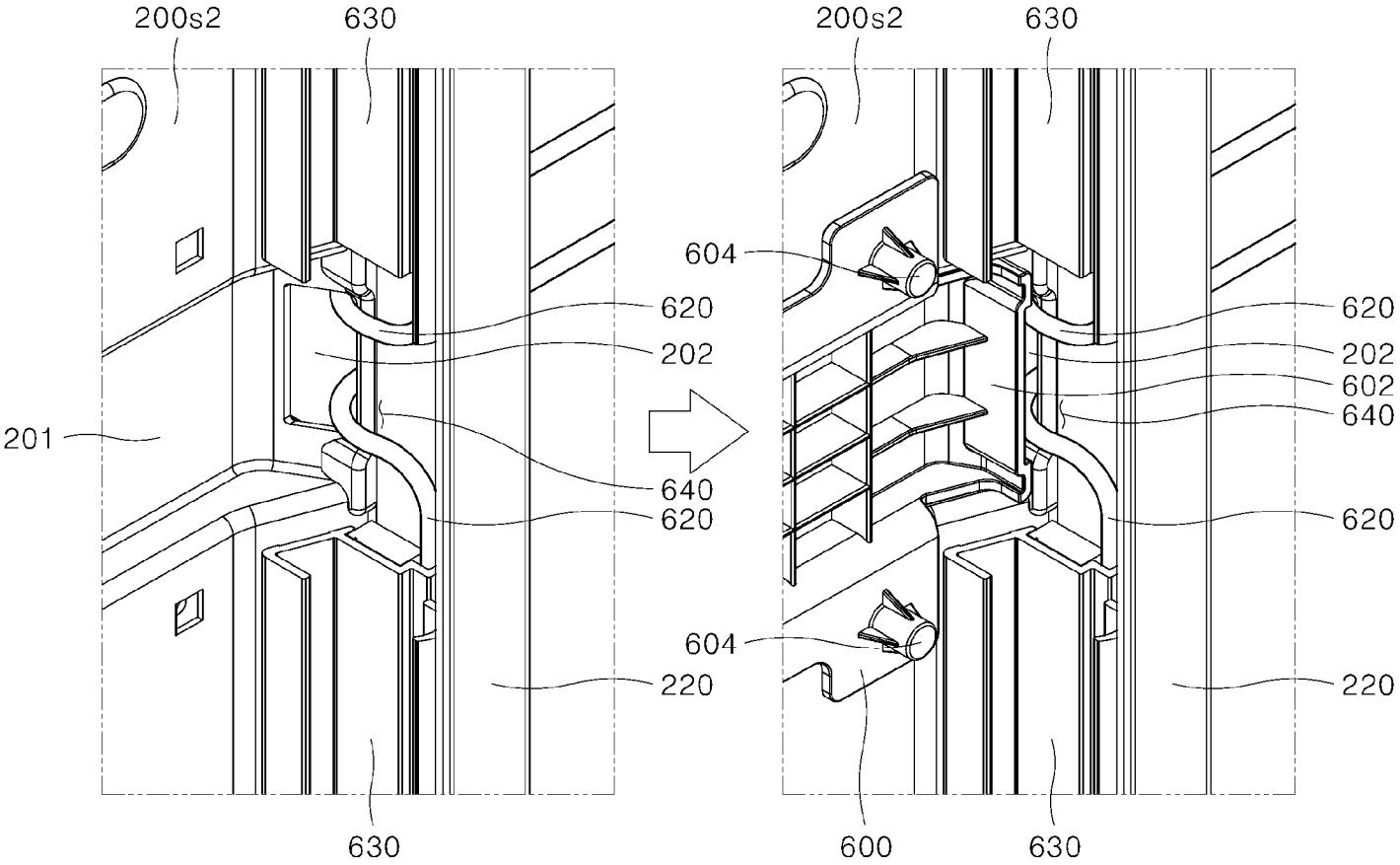
FIG. 16 shows views before and after a supporter housing for covering a hot line outlet is disposed.

Further referring to FIGS. 15 and 16, the supporter housing 600 may be formed to extend rearward from a rear surface of the second front wall 220 along the guide rail 201.

The supporter housing 600 may include a fastening bush 604 that may be fastened to the second upper plate fixing portion 413 of the second barrier 400 by the fastening member 4131 with the other side surface 200s2 of the storage casing interposed therebetween.

As such, the supporter housing 600 is fastened by the fastening member 4131 with the structure of the second barrier 400 and the fastening bush 604 with the storage casing 200 interposed therebetween, so that the second barrier 400 and the supporter housing 600 may share the fastening member 4131, thereby reducing the number of processes and material costs.

The supporter housing 600 may form a lighting housing 601 corresponding to the through-hole through which the harness connector 453 may extend.

The lighting housing 601 may also serve to protect the lighting harness 452 by covering the through-hole.

The supporter housing 600 extending along the guide rail 201 may increase overall strength by including reinforcing ribs 603 formed in vertical and horizontal directions.

The supporter housing 600 may include an outlet cover 602 to seal the hot line outlet 202 through which the hot line 620 protrudes forward.

The outlet cover 602 may be formed to have a shape covering an evacuation area 640 of the hot line 620.

As such, the outlet cover 602 is formed to cover the hot line outlet 202, so that the leakage of the foam liquid injected into the refrigerator 1 in a subsequent process may be prevented as much as possible.

In addition, the outlet cover 602 may also serve as a support for providing a function of preventing bulging near the evacuation area 640 of the hot line 620 when the foam liquid is injected.

Figure 17:
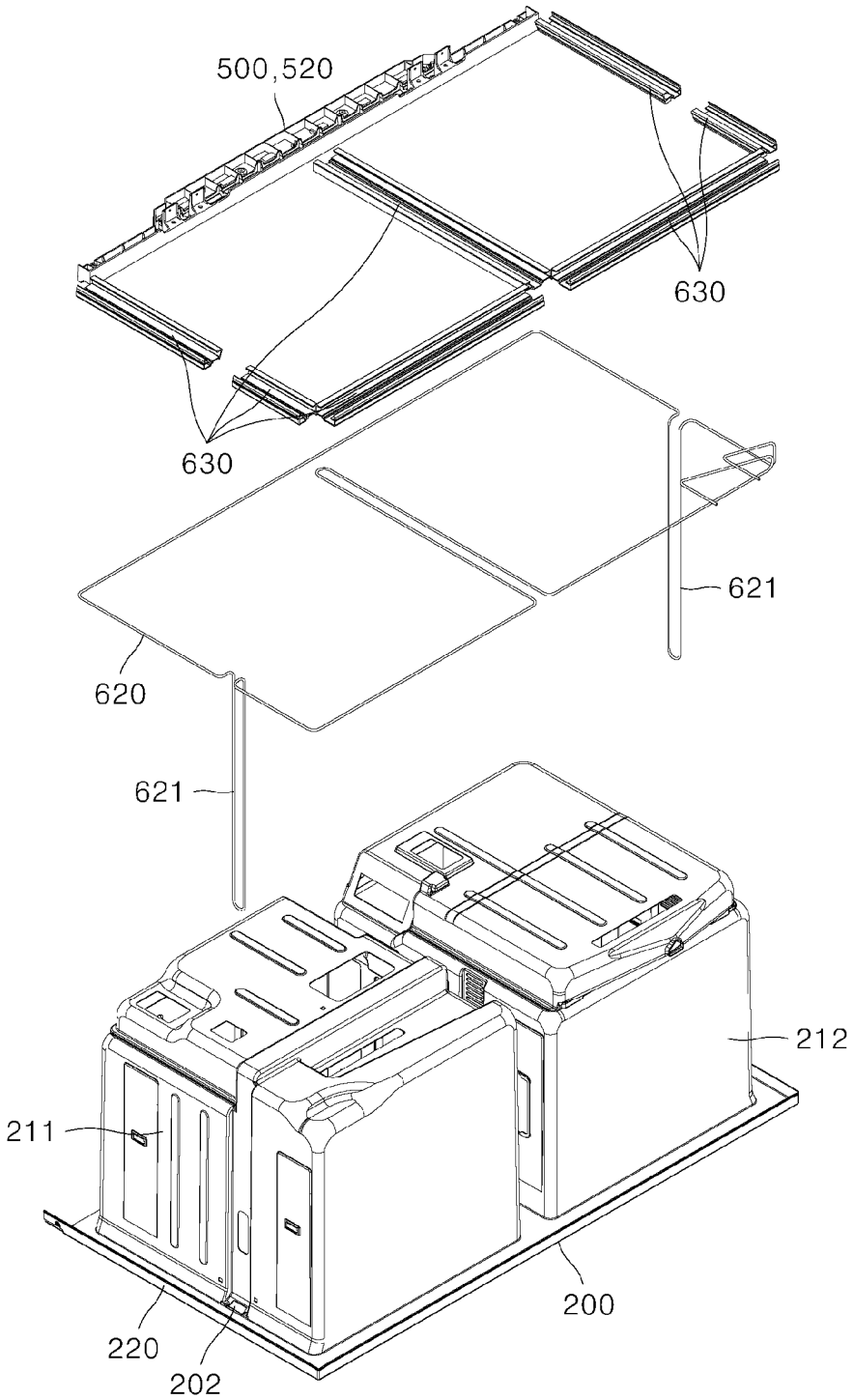
FIGS. 17 and 18 show views before and after a hot line is disposed on a rear surface of a storage casing.
Figure 18:
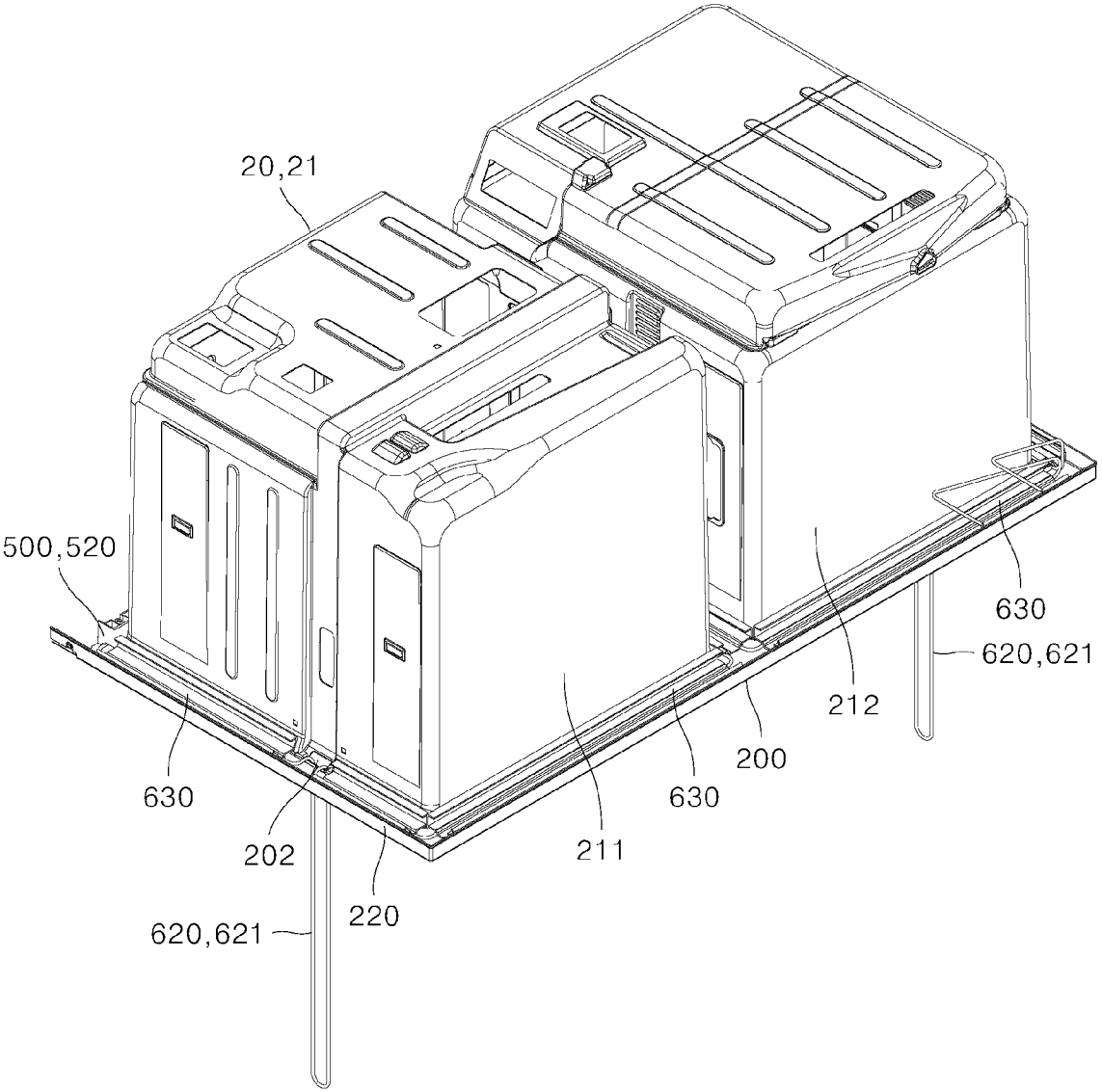
Figure 19:
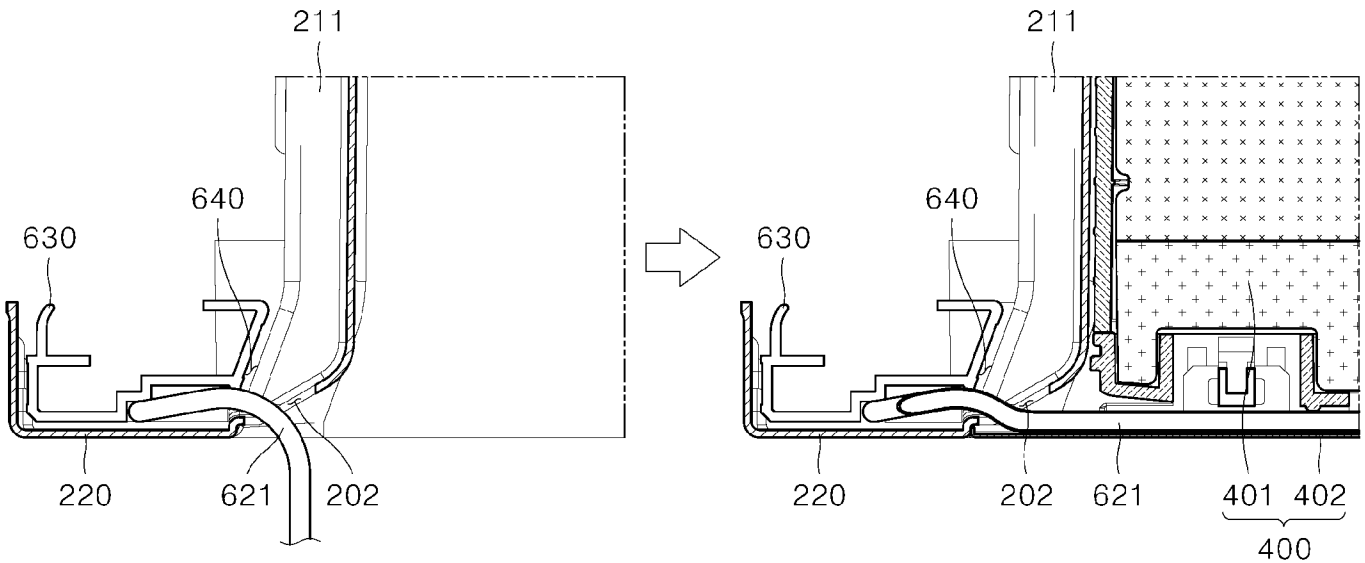
FIG. 19 shows before and after a hot line is bent to a front surface of a second barrier.

Hereinafter, the hot line 620 disposed on the rear surface of the storage casing 200 will be described in detail with reference to FIGS. 17 to 19.

The hot line 620 may be disposed by being inserted from behind along an edge of a rear surface of the second front wall 220 of the storage casing 200.

When the storage casing 200 includes the first storage compartment 211 and the second storage compartment 212, which are the plurality of storage compartments spaced apart from each other, the hot line 620 may also be disposed along a rear surface of the partition 221 disposed between the first storage compartment 211 and the second storage compartment 212.

The hot line 620 may be disposed between the second front wall 220 of the second inner casing 200 and a coupling assembly 500, and may be fixed by the coupling assembly 500.

In addition, the hot line 620 may be fixed by a decoration member 630 disposed along the edge of the second front wall 220 in addition to the coupling assembly 500.

In one example, portions of the hot line 620 may protrude forward via a pair of hot line outlets 202 defined at both sides of the storage casing 200.

For example, the hot line protrusion 621 protruding forward via the hot line outlet 202 may be assembled to stand in the vertical direction and be withdrawn forward from the hot line outlet 202.

After the decor member 630 is fixed so as not to be lifted by a separate additional fixing member such as a clamp using a jig facility, the hot line protrusions 621 protruding forward may be bent inwardly of the storage casing 200 so as to overlap the front surfaces of the first barrier 300 and the second barrier 400 using rotating rollers, respectively.

In this case, the hot line outlet 202 may be located at the rear of the second front wall 220, so that no step is formed at the front surface even when the hot line protrusion 621 is bent.

In addition, the hot line outlet 202 is defined in a form of a through-hole inclined toward the inside of the storage casing 200, which is a direction in which the hot line protrusion 621 is bent, so that the bending process of the hot line protrusion 621 may be performed more easily and the hot line outlet 202 may be prevented from interfering with the hot line protrusion 621.

In addition, as the evacuation area 640 where the hot line 620 does not interfere is formed on the hot line outlet 202, when the hot line 620 is assembled or bent, a molded article such as the decoration member may be prevented from lifting.

The bent hot line protrusions 621 may be fixed between the first body 301 and the first front plate 302 and between the second body 401 and the second front plate 402, respectively.

As such, in the refrigerator according to the present disclosure, the hot line is installed along the rear surface of the storage casing, but the hot line protrusion, which is the portion of the hot line installed along the front surface of the storage casing, is disposed along the front surface of the barrier and covered with the front plate, so that there is an effect of providing a hot line installation structure that may minimize a structure that conceals the hot line.

In addition, as described above, the refrigerator according to the present disclosure includes the barrier, which is the separate structure that partitions the storage compartment of the storage casing into the plurality of storage compartments, so that a structure that is difficult to implement with a molding scheme of molding the storage casing may be implemented with a separate molding scheme.

That is, the barrier provides various functions such as lighting, insulation, and heat wire functions as well as the function of partitioning the storage compartment, so that the barrier requires a complex structure that is difficult to implement by forming it collectively with the same molding method as the storage casing.

Therefore, according to the present disclosure, by selecting a structure in which the barrier is molded separately from the storage casing and assembled with the storage casing, the structure that is difficult to implement by the vacuum molding method for molding the storage casing may be molded with a separate injection-molding method and easily assembled.

As described above, the present disclosure has been described with reference to the drawings illustrated, but the present disclosure is not limited by the embodiments disclosed herein and drawings, and it is obvious that various modifications may be made by those skilled in the art within the scope of the technical idea of the present disclosure. In addition, although the operational effects based on the configuration of the present disclosure have not been explicitly described while describing the embodiments of the present disclosure, it is obvious that the effects predictable by the corresponding configuration should also be acknowledged.

What is claimed is:

1. A refrigerator comprising:

a storage casing including:

a first storage compartment; and a front wall integrally formed with the storage casing and protruding outward along a front edge of the first storage compartment;

a hot line located along a rear surface of the front wall; and a first barrier located inside the first storage compartment so as to cross the first storage compartment in a left and right direction, the first barrier partitioning the first storage compartment into a first first storage compartment and a second first storage compartment, wherein a hot line outlet formed in one side of the storage casing in contact with the first barrier is configured to allow a first portion of the hot line to be withdrawn therethrough, and wherein a second portion of the hot line extends inwardly with respect to the storage casing so as to overlap a front surface of the first barrier.

2. The refrigerator of claim 1, wherein the first barrier is in contact with opposite side surfaces and a rear surface of the first storage compartment.

3. The refrigerator of claim 1, wherein the first first storage compartment and the second first storage compartment are controlled to be at different temperatures.

4. The refrigerator of claim 1, wherein the first first storage compartment is configured to be switchable between a freezer compartment and a refrigerating compartment, and wherein the second first storage compartment is a freezer compartment.

5. The refrigerator of claim 1, wherein cool air circulating through the first first storage compartment and cool air circulating through the second first storage compartment are discharged to different cool air outlets and recovered via different cool air recovery ports in the first storage compartment.

6. A refrigerator comprising:

a storage casing including:

a first storage compartment;

a second storage compartment arranged adjacent the first storage compartment in a left and right direction; and a front wall protruding outward along front edges of the first storage compartment and the second storage compartment;

a first barrier located within the first storage compartment so as to cross the first storage compartment in the left and right direction;

a second barrier located within the second storage compartment so as to cross the second storage compartment in the left and right direction; and a hot line located along a rear surface of the front wall, wherein a pair of hot line outlets configured to allow first portions of the hot line to be withdrawn therethrough are located in a first side of the storage casing in contact with the first barrier and a second side of the storage casing in contact with the second barrier, respectively, and wherein second portions of the hot line extend inwardly with respect to the storage casing so as to overlap front surfaces of the first barrier and the second barrier, respectively.

7. The refrigerator of claim 6, wherein the first barrier includes:

a first body; and a first front plate located at a front surface of the first body, wherein the second barrier includes:

a second body; and a second front plate located at a front surface of the second body, and wherein the second portions of the hot line are located between the first body and the first front plate and between the second body and the second front plate, respectively.

8. The refrigerator of claim 6, wherein the storage casing includes a partition crossing the storage casing in a vertical direction such that the storage casing is partitioned into the first storage compartment and the second storage compartment, wherein the first barrier partitions the first storage compartment into a first first storage compartment and a first lower second first storage compartment, and wherein the second barrier partitions the second storage compartment into a first second storage compartment and a second second storage compartment.

9. The refrigerator of claim 8, wherein the second barrier is configured such that the first second storage compartment and the second second storage compartment are in fluid communication with each other.

10. The refrigerator of claim 9, wherein a length of the second barrier in a front to rear direction is less than a length of the storage compartment in the front to rear direction.

11. The refrigerator of claim 8, wherein the first barrier is configured such that the first first storage compartment and the second first storage compartment are not in fluid communication with each other.

12. The refrigerator of claim 8, wherein the first first storage compartment and the second first storage compartment are configured to be controlled at different temperatures, and wherein the first second storage compartment and the second second storage compartment are configured to be controlled at a same temperature.

13. The refrigerator of claim 8, wherein the partition includes a cool air recovery communication-hole configured to allow the second first storage compartment and the second second storage compartment to be in fluid communication with each other, and wherein the second first storage compartment, the first second storage compartment, and the second second storage compartment are configured to be controlled at a same temperature.

14. The refrigerator of claim 8, wherein the second first storage compartment, the first second storage compartment, and the second second storage compartment are freezer compartments.

15. The refrigerator of claim 8, wherein cool air circulating through the first second storage compartment and cool air circulating through the second second storage compartment are discharged to a same cool air outlet and recovered via a same cool air recovery port.

16. The refrigerator of claim 6, wherein the first barrier and the second barrier are slidably insertable into the first storage compartment and the second storage compartment, respectively.

17. The refrigerator of claim 6, wherein the first barrier includes a heat plate arranged along an upper surface or a lower surface thereof, and wherein an inside of the first barrier is filled with a foam insulator.

18. The refrigerator of claim 6, wherein the first storage compartment is partitioned into a first first storage compartment and a second first storage compartment by the first barrier, and wherein the second storage compartment is partitioned into a first second storage compartment and a second second storage compartment by the second barrier.

19. The refrigerator of claim 18, further comprising a plurality of doors, each door being configured to open and close a respective one of the first first storage compartment, the second first storage compartment, the first second storage compartment, and the second second storage compartment, each door including a gasket magnet contacting one of a front surface of the first barrier or a front surface of the second barrier, the gasket magnets being located on rear surfaces of the plurality of doors.

20. The refrigerator of claim 6, wherein each of the first barrier and the second barrier includes a light.

* * * * *